US012612909B2

(12) United States Patent
Clyburn

(10) Patent No.: US 12,612,909 B2
(45) Date of Patent: Apr. 28, 2026

(54) PROTECTION OF MAKE-UP SYSTEM FOR HIGH PRESSURE BELLOWS-STYLE PUMP SYSTEM

(71) Applicant: Halliburton Energy Services, Inc., Houston, TX (US)

(72) Inventor: Andrew Silas Clyburn, Duncan, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 18/399,058

(22) Filed: Dec. 28, 2023

(65) Prior Publication Data

US 2024/0376888 A1 Nov. 14, 2024

Related U.S. Application Data

(60) Provisional application No. 63/502,056, filed on May 12, 2023.

(51) Int. Cl.
*F04B 51/00* (2006.01)
*F04B 43/00* (2006.01)
(Continued)

(52) U.S. Cl.
CPC ..... *F04B 51/00* (2013.01); *F04B 43/0081* (2013.01); *F04B 43/009* (2013.01);
(Continued)

(58) Field of Classification Search
CPC .. F04B 43/0081; F04B 43/009; F04B 43/067; F04B 43/073; F04B 43/107; F04B 51/00
See application file for complete search history.

(56) References Cited

U.S. PATENT DOCUMENTS 1,256,127 A 2/1918 Gould
1,301,485 A 4/1919 Mueller
(Continued)

FOREIGN PATENT DOCUMENTS

CN 201982789 U 9/2011
CN 104763410 A 7/2015
(Continued)

OTHER PUBLICATIONS

First Office Action dated Apr. 28, 2025 (45 pages), U.S. Appl. No. 18/398,878, filed Dec. 28, 2023.
(Continued)

*Primary Examiner* — Charles G Freay
(74) *Attorney, Agent, or Firm* — Conley Rose, P.C.; Rodney B. Carroll

(57) ABSTRACT

In a bellows pump, detecting and addressing any leakage of treatment fluid into the bellows can be important. Disclosed embodiments may relate to a bellows pump system configured to better prevent contamination due to bellows leakage. For example, the system may include a bellows pump, a make-up system, and a control system. The make-up system may comprise a make-up fluid source fluidly coupled to the bellows and at least one other component of the system. The control system may be configured to receive and evaluate data from one or more sensor, and responsive to detecting a leak using the data, to fluidly isolate the make-up system from the bellows, which may prevent spread of contamination in the system. Related methods and systems are also disclosed.

6 Claims, 10 Drawing Sheets

(51) Int. Cl.
*F04B 43/067* (2006.01)
*F04B 43/073* (2006.01)
*F04B 43/107* (2006.01)

(52) U.S. Cl.
CPC ..... *F04B 43/067* (2013.01); *F04B 43/073* (2013.01); *F04B 43/107* (2013.01)

(56) References Cited

U.S. PATENT DOCUMENTS

| | | | | |
|---|---|---|---|---|
| 1,650,377 | A | 11/1927 | Nixon | |
| 1,832,257 | A | 11/1931 | Stephens | |
| 2,464,095 | A | 3/1949 | Nies | |
| 2,546,302 | A * | 3/1951 | Gehres | F04B 43/009 92/99 |
| 2,613,607 | A | 10/1952 | Sheen et al. | |
| 2,735,369 | A | 2/1956 | Turvey | |
| 2,807,215 | A | 9/1957 | Hawxhurst | |
| 3,134,508 | A | 5/1964 | Yer et al. | |
| 3,151,562 | A | 10/1964 | Swartz | |
| 3,192,860 | A | 7/1965 | Hardison | |
| 3,338,170 | A | 8/1967 | Swartz | |
| 3,411,452 | A | 11/1968 | Czarnecki et al. | |
| 3,433,161 | A | 3/1969 | Vetter | |
| 3,524,714 | A | 8/1970 | Grove et al. | |
| 3,680,981 | A | 8/1972 | Wagner | |
| RE29,055 | E | 11/1976 | Wagner | |
| 4,003,679 | A | 1/1977 | McManigill | |
| 4,080,107 | A | 3/1978 | Ferrentino | |
| 4,406,595 | A | 9/1983 | Robertson et al. | |
| 4,439,112 | A | 3/1984 | Kitsnik | |
| 4,442,957 | A | 4/1984 | Neal et al. | |
| 4,594,057 | A | 6/1986 | Morgan | |
| 4,948,349 | A | 8/1990 | Koiwa | |
| 5,220,943 | A | 6/1993 | Zink | |
| 5,246,351 | A | 9/1993 | Horn et al. | |
| 5,249,932 | A | 10/1993 | Van Bork | |
| 5,308,230 | A | 5/1994 | Moore | |
| 6,419,462 | B1 | 7/2002 | Horie et al. | |
| 6,554,578 | B1 | 4/2003 | Siegel | |
| 9,243,413 | B2 | 1/2016 | Robol et al. | |
| 9,518,577 | B2 | 12/2016 | van Boeyen et al. | |
| 10,408,204 | B2 | 9/2019 | Suzuki | |
| 10,408,207 | B2 | 9/2019 | Yamada et al. | |
| 10,480,296 | B2 | 11/2019 | Beisel | |
| 10,895,254 | B2 | 1/2021 | Beisel | |
| 10,947,967 | B1 | 3/2021 | Surjaatmadja et al. | |
| 11,125,225 | B2 | 9/2021 | Beisel | |
| 11,268,502 | B2 | 3/2022 | Mollatt | |
| 11,286,920 | B2 | 3/2022 | Mollatt | |
| 11,346,336 | B2 | 5/2022 | Surjaatmadja et al. | |
| 11,401,792 | B2 | 8/2022 | Mollatt | |
| 11,415,123 | B2 | 8/2022 | Hunter et al. | |
| 2003/0031565 | A1 | 2/2003 | Kleibrink | |
| 2006/0008364 | A1 * | 1/2006 | Traylor | F04B 43/107 417/390 |
| 2007/0065305 | A1 | 3/2007 | Budde et al. | |
| 2007/0074872 | A1 | 4/2007 | Du et al. | |
| 2008/0145248 | A1 | 6/2008 | Kato et al. | |
| 2009/0041588 | A1 | 2/2009 | Hunter et al. | |
| 2012/0091165 | A1 | 4/2012 | Cedrone et al. | |
| 2012/0308409 | A1 | 12/2012 | Levine | |
| 2015/0148919 | A1 | 5/2015 | Watson | |
| 2016/0097384 | A1 | 4/2016 | Menjoh et al. | |
| 2016/0123313 | A1 * | 5/2016 | Simmons | F04B 9/133 417/392 |
| 2018/0313196 | A1 | 11/2018 | Frantz, III et al. | |
| 2019/0383279 | A1 | 12/2019 | Simmons et al. | |
| 2020/0217186 | A1 * | 7/2020 | Mollatt | F04B 9/00 |
| 2020/0256333 | A1 | 8/2020 | Surjaatmadja et al. | |
| 2020/0277951 | A1 | 9/2020 | Hunter et al. | |
| 2020/0309113 | A1 | 10/2020 | Hunter et al. | |
| 2021/0140294 | A1 | 5/2021 | Mollatt | |
| 2021/0148354 | A1 | 5/2021 | Adams | |
| 2021/0173111 | A1 | 6/2021 | Therrien et al. | |
| 2021/0190065 | A1 | 6/2021 | Ferden et al. | |
| 2021/0246894 | A1 | 8/2021 | Mollatt | |
| 2022/0178368 | A1 | 6/2022 | Montilla Jimenez et al. | |
| 2024/0376809 | A1 | 11/2024 | Hurst et al. | |
| 2024/0376881 | A1 | 11/2024 | Hurst et al. | |
| 2024/0376887 | A1 | 11/2024 | Hurst et al. | |
| 2025/0163784 | A1 | 5/2025 | Clyburn et al. | |

FOREIGN PATENT DOCUMENTS

| | | | |
|---|---|---|---|
| CN | 106761573 | B | 4/2019 |
| DE | 596227 | C | 7/1934 |
| DE | 2253288 | A1 | 5/1974 |
| DE | 3706338 | A1 | 9/1988 |
| EP | 1602830 | A1 | 7/2005 |
| EP | 2913525 | A1 | 2/2015 |
| EP | 4286688 | A1 | 6/2023 |
| FR | 1441747 | A | 6/1966 |
| FR | 2367203 | A2 | 5/1978 |
| GB | 2185291 | A | 7/1987 |
| JP | 6093190 | A | 5/1985 |
| JP | 1257775 | A | 10/1989 |
| JP | H11159464 | A | 6/1999 |
| JP | 2006200464 | B2 | 8/2006 |
| JP | 2007100663 | A | 4/2007 |
| KR | 1020170016059 | A | 8/2018 |
| SU | 1359482 | A1 | 12/1987 |
| WO | 2015078487 | A1 | 6/2015 |
| WO | 2022099219 | A1 | 5/2022 |
| WO | 2022164034 | A1 | 8/2022 |

OTHER PUBLICATIONS

Filing Receipt, Specification and Drawings for U.S. Appl. No. 18/398,858, filed Dec. 28, 2023, entitled "Bellows Failure Detection for a Pump," 70 pages.

Filing Receipt, Specification and Drawings for U.S. Appl. No. 18/398,878, filed Dec. 28, 2023, entitled "Direct Connect Piston-Driven Bellows Pump," 96 pages.

Filing Receipt, Specification and Drawings for U.S. Appl. No. 18/398,905, filed Dec. 28, 2023, entitled "Valve Monitoring System for a Bellows Pump," 91 pages.

Filing Receipt, Specification and Drawings for U.S. Appl. No. 18/398,923, filed Dec. 28, 2023, entitled "Active Bellows Pump Valve Management," 81 pages.

Filing Receipt, Specification and Drawings for U.S. Appl. No. 18/399,058, filed Dec. 28, 2023, entitled Protection of Make-Up System for High Pressure Bellows-Stylepump System, 91 pages.

Foreign Communication from Related Application—International Search Report and Written Opinion of the International Searching Authority, International Application No. PCT/US2023/086392, dated Apr. 19, 2024, 11 pages.

Filing Receipt, Specification and Drawings for U.S. Appl. No. 18/398,936, filed Dec. 28, 2023, entitled "Systems and Methods Using a Bellows Pump to Perform Operations for a Subterranean Formation," 81 pages.

First Office Action dated Mar. 12, 2025 (8 pages), U.S. Appl. No. 18/398,936, filed Dec. 28, 2023.

Filing Receipt, Specification and Drawings for U.S. Appl. No. 18/398,885, filed Dec. 28, 2023, entitled "Improved Cooling for Bellows Pump," 80 pages.

Foreign Communication from Related Application—International Search Report and Written Opinion of the International Searching Authority, International Application No. PCT/US2023/086404, dated Apr. 24, 2024, 10 pages.

Foreign Communication from Related Application—International Search Report and Written Opinion of the International Searching Authority, International Application No. PCT/US2023/086394, dated Apr. 24, 2024, 11 pages.

Foreign Communication from Related Application—International Search Report and Written Opinion of the International Searching Authority, International Application No. PCT/US2023/086395, dated Apr. 30, 2024, 11 pages.

(56) References Cited

OTHER PUBLICATIONS

Foreign Communication from Related Application—International Search Report and Written Opinion of the International Searching Authority, International Application No. PCT/US2023/086389, dated May 1, 2024, 11 pages.
Foreign Communication from Related Application—International Search Report and Written Opinion of the International Searching Authority, International Application No. PCT/US2023/086385, dated May 7, 2024, 11 pages.
Foreign Communication from Related Application—International Search Report and Written Opinion of the International Searching Authority, International Application No. PCT/US2023/086397, dated May 7, 2024, 10 pages.
First Office Action dated Jun. 23, 2025 (47 pages), U.S. Appl. No. 18/399,058, filed Dec. 28, 2023.
First Office Action dated Jul. 2, 2025 (40 pages), U.S. Appl. No. 18/398,905, filed Dec. 28, 2023.
First Office Action dated May 2, 2025 (28 pages), U.S. Appl. No. 18/398,923, filed Dec. 28, 2023.
Office Action dated March 5, 20265 (20 pages), U.S. Appl. No. 18/398,858, filed Dec. 28, 2023.

* cited by examiner

PROTECTION OF MAKE-UP SYSTEM FOR HIGH PRESSURE BELLOWS-STYLE PUMP SYSTEM

CROSS-REFERENCE TO RELATED APPLICATIONS

This application claims priority benefit under 35 U.S.C. 119 (e) of U.S. Provisional Patent Application Ser. No. 63/502,056 (filed May 12, 2023), which is incorporated by reference herein in its entirety.

STATEMENT REGARDING FEDERALLY SPONSORED RESEARCH OR DEVELOPMENT

Not applicable.

FIELD

This disclosure relates generally to the field of pumping, for example pumping of fluids downhole in a well. More particularly, this disclosure relates to systems and methods relating to bellows pumps.

BACKGROUND

To produce hydrocarbons (for example, oil, gas, etc.) from a subterranean formation, wellbores may be drilled that penetrate hydrocarbon-containing portions of the subterranean formation. The portion of the subterranean formation from which hydrocarbons may be produced is commonly referred to as a "production zone." In some instances, a subterranean formation penetrated by the wellbore may have multiple production zones at various locations along the wellbore.

Generally, after a wellbore has been drilled to a desired depth, completion operations are performed. Such completion operations may include inserting a liner or casing into the wellbore and, at times, cementing the casing or liner into place. Once the wellbore is completed as desired (lined, cased, open hole, or any other known completion), treatment, such as a stimulation operation, may be performed to enhance hydrocarbon production into the wellbore. Examples of some common stimulation operations involve hydraulic fracturing, acidizing, fracture acidizing, and hydro-jetting. Stimulation operations are intended to increase the flow of hydrocarbons from the subterranean formation surrounding the wellbore into the wellbore itself so that the hydrocarbons may then be produced up to the wellhead.

One typical formation stimulation process may involve hydraulic fracturing of the formation and placement of a proppant in those fractures. Typically, a treatment/stimulation fluid (which may comprise a clean fluid and a proppant) may be mixed at the surface before being pumped downhole in order to induce fractures or perforations in the formation of interest. The creation of such fractures or perforations will increase the production of hydrocarbons by increasing the flow paths into the wellbore.

Various types of pumps have been used in well operations such as hydraulic fracturing. However, given the difficult conditions and related wear and reliability issues that may arise when pumping treatment fluids for a hydrocarbon well, there is need for improved pumps and related systems and methods.

BRIEF DESCRIPTION OF THE DRAWINGS

For a more complete understanding of the present disclosure, reference is now made to the following brief description, taken in connection with the accompanying drawings and detailed description, wherein like reference numerals represent like parts.

DETAILED DESCRIPTION

Figure 1:
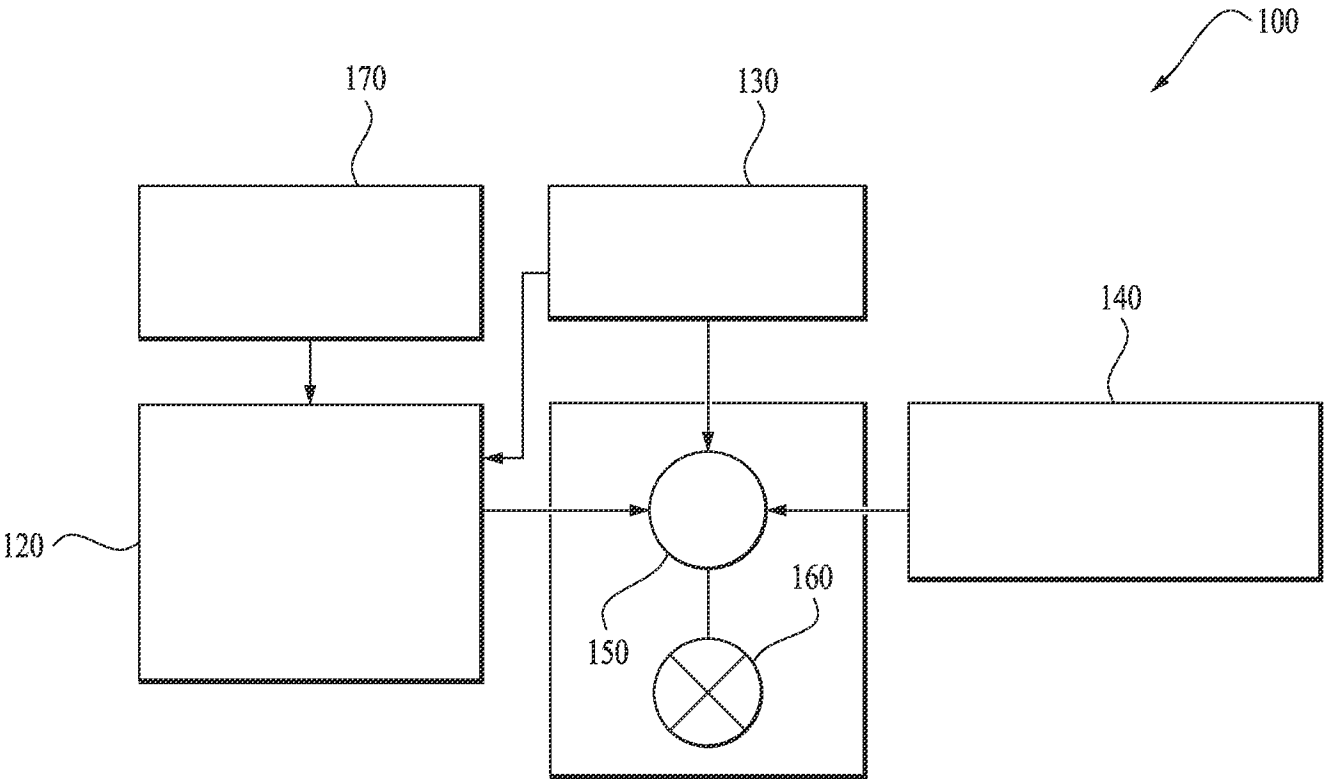
FIG. 1 is a schematic illustration of an exemplary well treatment system, such as an exemplary fracturing system, according to an embodiment of the disclosure.

It should be understood at the outset that although illustrative implementations of one or more embodiments are illustrated below, the disclosed systems and methods may be implemented using any number of techniques, whether currently known or not yet in existence. The description that follows includes example systems, methods, techniques, and program flows that embody aspects of the disclosure. However, it is understood that this disclosure may be practiced without these specific details. For brevity, well-known steps, protocols, structures, and techniques have not been shown in detail in order not to obfuscate the description. The disclosure should in no way be limited to the illustrative implementations, drawings, and techniques illustrated below, but may be modified within the scope of the appended claims along with their full scope of equivalents.

As used herein the terms "uphole", "upwell", "above", "top", and the like refer directionally in a wellbore towards the surface, while the terms "downhole", "downwell", "below", "bottom", and the like refer directionally in a wellbore towards the toe of the wellbore (e.g. the end of the wellbore distally away from the surface), as persons of skill will understand. Orientation terms "upstream" and "downstream" are defined relative to the direction of flow of fluid. "Upstream" is directed counter to the direction of flow of fluid, while "downstream" is directed in the direction of flow of fluid, as persons of skill will understand.

Disclosed embodiments illustrate exemplary devices, systems, and methods for using treatment fluids to carry out subterranean treatments in conjunction with a variety of subterranean operations, including but not limited to, hydraulic fracturing operations, fracturing acidizing operations to be followed with proppant hydraulic fracturing operations, stimulation treatments, drilling, cementing, and the like. For example, treatment fluid may be introduced into a wellbore (e.g. which penetrates a subterranean formation) at a pressure sufficient to create or enhance one or more fractures within the subterranean formation (for example, hydraulic fracturing) and/or to create or enhance and treat microfractures within a subterranean formation in fluid communication with a primary fracture in the formation. In one or more embodiments, the systems and methods of the present disclosure may be used to treat pre-existing fractures, or fractures created using a different treatment fluid. In one or more embodiment, a treatment fluid may be introduced at a pressure sufficient to create or enhance one or more fractures within the formation, and/or one or more of the treatment fluids may include a proppant material which subsequently may be introduced into the formation. In embodiments, treatment fluid can be any fluid (and may in some instances include solid particles therein) which can be pumped into a well. In embodiments, treatment fluid may differ from drive fluid used within a pump mechanism.

By way of example, FIG. 1 schematically illustrates an exemplary fracturing system 100. The fracturing system 100 may be implemented using the systems, methods, and techniques described herein. In particular, the disclosed systems, methods, and techniques may directly or indirectly affect one or more components or pieces of equipment associated with the example fracturing system 100, according to one or more embodiments. In embodiments, the fracturing system 100 may comprise one or more of the following: a fracturing fluid producing apparatus 120, a fluid source 130, a solid source 140, an additive source 170, and a pump and blender system 150. All or an applicable combination of these components of the fracturing system 100 may reside at the surface at a well site/fracturing pad where a well 160 can be located.

During a fracturing job, the fracturing fluid producing apparatus 120 may access the fluid source 130 for introducing/controlling flow of a fluid, e.g. a treatment fluid such as fracturing fluid, in the fracturing system 10. While only a single fluid source 130 is shown, the fluid source 130 may include a plurality of separate fluid sources (e.g. storage tanks). In some embodiments, the fracturing fluid producing apparatus 120 may be omitted from the fracturing system 100, with the fracturing fluid instead being sourced directly from the fluid source 130 during a fracturing job rather than through the intermediary fracturing fluid producing apparatus 120.

The fracturing fluid may be an applicable fluid for forming fractures during a fracture stimulation treatment of the well 160. For example, the fracturing fluid may include water, a hydrocarbon fluid, a polymer gel, foam, air, wet gases, and/or other applicable fluids. In various embodiments, the fracturing fluid may include a concentrate to which additional fluid is added prior to use in a fracture stimulation of the well 160. In certain embodiments, the fracturing fluid may include a gel pre-cursor with fluid, e.g. liquid or substantially liquid, from fluid source 130. Accordingly, the gel pre-cursor with fluid may be mixed by the fracturing fluid producing apparatus 120 to produce a hydrated fracturing fluid for forming fractures.

The solid source 140 may include a volume of one or more solids which may be mixed with a fluid, e.g. the fracturing fluid, to form a solid-laden fluid. The solid-laden fluid may be pumped into the well 160 as part of a solid-laden fluid stream that is used to form and stabilize fractures in the well 160 during a fracturing job. The one or more solids within the solid source 140 may include applicable solids that may be added to the fracturing fluid of the fluid source 130. Specifically, the solid source 140 may contain one or more proppants for stabilizing fractures after they are formed during a fracturing job, e.g. after the fracturing fluid flows out of the formed fractures. For example, the solid source 140 may contain sand.

The fracturing system 100 may also include an additive source 170. The additive source 170 may contain/provide one or more applicable additives that may be mixed into fluid, e.g. the fracturing fluid, during a fracturing job. For example, the additive source 170 may include solid-suspension-assistance agents, gelling agents, weighting agents, and/or other optional additives to alter the properties of the fracturing fluid. The additives may be included in the fracturing fluid to reduce pumping friction, to reduce or eliminate the fluid's reaction to the geological formation in which the well is formed, to operate as surfactants, and/or to serve other applicable functions during a fracturing job. As will be discussed in greater detail later, the additives may function to maintain solid particle suspension in a mixture of solid particles and fracturing fluid as the mixture is pumped down the well 160 to one or more perforations.

The pump and blender system 150 functions to pump treatment fluid into the well 160. Specifically, the pump and blender system 150 of FIG. 1 may pump fracture fluid from the fluid source 130, e.g. fracture fluid that is received through the fracturing fluid producing apparatus 120, into the well 160 for forming and potentially stabilizing fractures as part of a fracture job. The pump and blender system 150 may include one or more pumps. Specifically, the pump and blender system 150 may include a plurality of pumps that may operate together, e.g. concurrently, to form fractures in a subterranean formation as part of a fracturing job. The one or more pumps included in the pump and blender system 150 may be any applicable type of fluid pump. For example, the pumps in the pump and blender system 150 may include electric pumps and/or hydrocarbon and hydrocarbon mixture powered pumps, such as diesel-powered pumps, natural gas-powered pumps, and diesel combined with natural gas-powered pumps. In one or more embodiments, one or more of the pumps in the pump and blender system 150 may be a bellows pump.

In some embodiments, the pump and blender system 150 may also function to receive the fracturing fluid and combine it with other components and solids (e.g. with the pump and blender system 150 optionally comprising a blender unit). Specifically, the pump and blender system 150 may combine the fracturing fluid with volumes of solid particles, e.g. proppant, from the solid source 140 and/or additional fluid and solids from the additive source 170. In turn, the pump and blender system 150 may pump the resulting mixture down the well 160 at a sufficient pumping rate to create or enhance one or more fractures in a subterranean zone, for example, to stimulate production of fluids from the zone. While the pump and blender system 150 is described to perform both pumping and mixing of fluids and/or solid particles, in various embodiments, the pump and blender system 150 may function to just pump a fluid stream, e.g. a treatment and/or fracture fluid stream, down the well 160 to create or enhance one or more fractures in a subterranean zone. In some embodiments, a separate pump and/or separate blender may be used (e.g. independently of each other or alone).

In embodiments, one or more elements/components of the system may be monitored (e.g. using one or more sensor). For example, the fracturing fluid producing apparatus 120, fluid source 130, and/or solid source 140 may be equipped with one or more monitoring devices (not shown). The monitoring devices may be used to control the flow of fluids, solids, and/or other compositions to the pumping and blender system 150. Such monitoring devices may effectively allow the pumping and blender system 150 to source from one, some, or all of the different sources at a given time. In turn, the pumping and blender system 150 may provide just fracturing fluid into the well 160 at some times, just solids or solid slurries at other times, and combinations of those components at other times.

Figure 2:
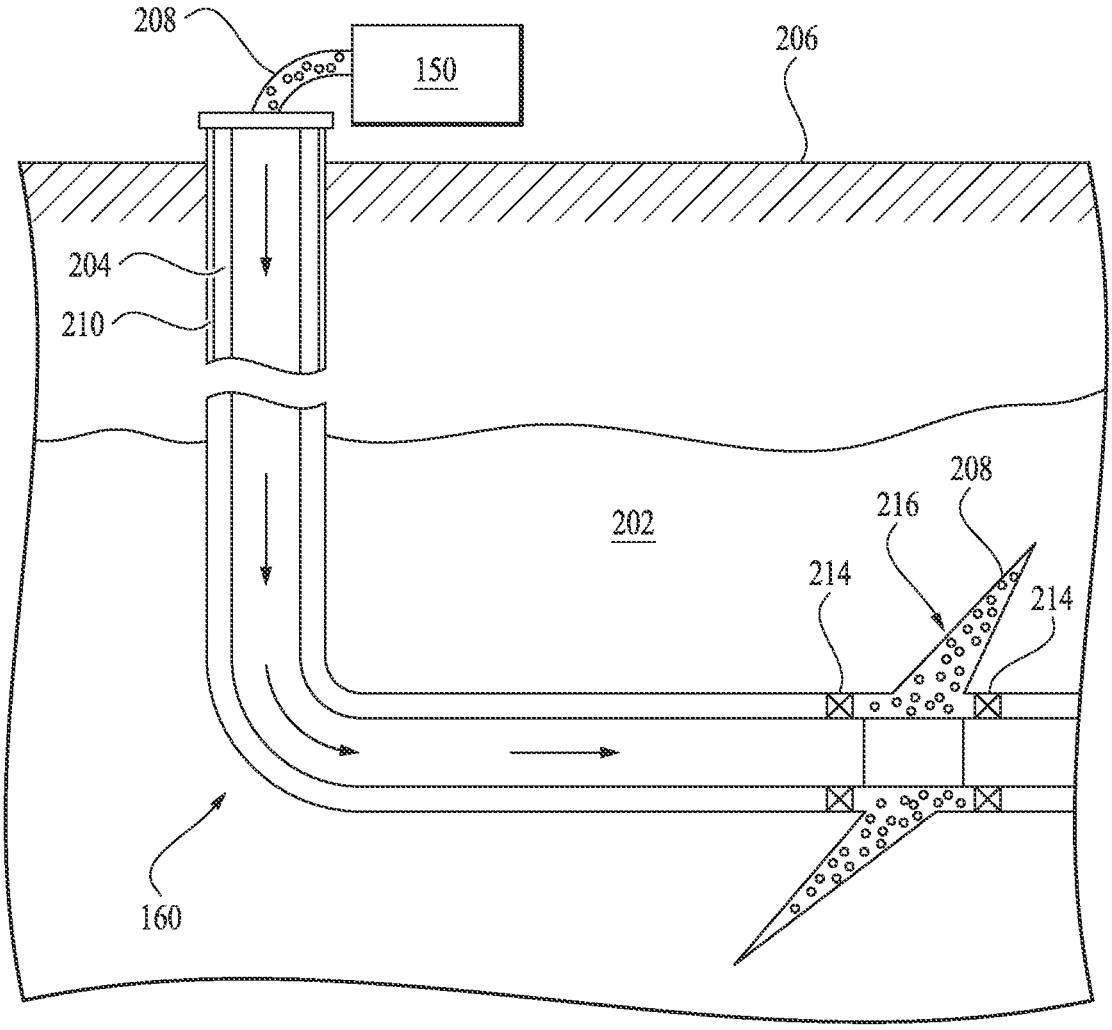
FIG. 2 is a schematic illustration of an exemplary well during a treatment operation, according to an embodiment of the disclosure.

FIG. 2 illustrates an exemplary well 160 during a treatment operation (e.g. a fracturing operation) in a portion of a subterranean formation of interest 202 surrounding a wellbore 204. In embodiments, the downhole operation may be performed using one or an applicable combination of the components in the example system 100 shown in FIG. 1. The wellbore 204 of FIG. 2 extends from a surface 206, and a fracturing fluid 208 is applied to a portion of the subterranean formation 202 (e.g. surrounding the horizontal portion of the wellbore 204). Although shown as vertical deviating to horizontal, the wellbore 204 may include horizontal, vertical, slant, curved, and other types of wellbore geometries and orientations, and the fracturing treatment may be applied to a subterranean zone surrounding any portion of the wellbore 204. The wellbore 204 may include a casing 210 that is cemented or otherwise secured to the wellbore wall. The wellbore 204 may be uncased or otherwise include uncased sections. Perforations may be formed in the casing 210 to allow fracturing fluids and/or other materials to flow into the subterranean formation 202. In the example fracture operation shown in FIG. 2, a perforation is created between points 214 (which may represent one or more packer element in some embodiments) defining an isolated zone.

The pump and blender system 150 (or in some embodiments, just a pump or a separate pump and a separate blender) may be fluidly coupled to the wellbore 204 to pump treatment fluid (e.g. fracturing fluid 208), and potentially other applicable solids and solutions, into the wellbore 204. When the fracturing fluid 208 is introduced into wellbore 204, it may flow through at least a portion of the wellbore 204 to the perforation, for example defined by points 214 in FIG. 2. The fracturing fluid 208 may be pumped at a sufficient pumping rate through at least a portion of the wellbore 204 to create one or more fractures 216 through the perforation and into the subterranean formation 202. Specifically, the fracturing fluid 208 may be pumped at a sufficient pumping rate to create a sufficient hydraulic pressure at the perforation to form the one or more fractures 216. Further, solid particles, e.g. proppant from the solid source 140, may be pumped into the wellbore 204, e.g. within the fracturing fluid 208 towards the perforation. In turn, the solid particles may enter the fractures 216 where they may remain after the fracturing fluid flows out of the wellbore. These solid particles may stabilize or otherwise "prop" the fractures 216, such that fluids may flow freely through the fractures 216.

While only two perforations at opposing sides of the wellbore 204 are shown in FIG. 2, greater than two perforations may be formed in the wellbore 204 as part of a perforation cluster. Fractures may then be formed through the plurality of perforations in the perforation cluster as part of a fracturing stage for the perforation cluster. Specifically, fracturing fluid and solid particles may be pumped into the wellbore 204 and pass through the plurality of perforations during the fracturing stage to form and stabilize the fractures through the plurality of perforations.

The pump and blender system 150 may comprise a pump (e.g. a high-pressure pump), which may be used, either alone or in combination with one or more other pumps, to pressurize a treatment fluid and/or introduce the treatment fluid into wellbore 204 penetrating at least a portion of a subterranean formation to perform a treatment therein. For example, in hydraulic fracturing operations, one or more pumps may be used to pump a treatment fluid (e.g. fracturing fluid 208, which typically may be a slurry mixture of proppant and/or sand mixed with water) into the formation.

In some embodiments, the pump may comprise a bellows pump 300, which may be configured to segregate treatment fluid from drive fluid (sometimes termed power fluid). See for example FIG. 3, which schematically illustrates a bellows pump 300. The bellows pump 300 may comprise a power end 310, a fluid end 320, and an expandable bellows 330. The fluid end 320 may have a chamber 321 within a fluid end housing 323, a suction valve 326 in fluid communication with (e.g. fluidly coupled to) the chamber 321 and a source/reservoir for the treatment fluid 350 (e.g. with the suction valve 326 being configured to allow for insertion of treatment fluid into the chamber 321), and a discharge valve 328 in fluid communication with (e.g. fluidly coupled to) the chamber 321 and the well (e.g. with the discharge valve 328 being configured to allow for insertion of treatment fluid from the chamber 321 into the well or any other place where treatment fluid is intended to be pumped). While the suction valve 326 and discharge valve 328 may be disposed within the housing 323 for the fluid end 320 in some embodiments, in other embodiments, the suction valve 326 and discharge valve 328 may be located within other components (such as piping) that fluidly couples the valves to the elements/components of the pump 300 as described.

In embodiment, the power end 310 may be fluidly connected to (e.g. in fluid communication with) the bellows 330 (e.g. the inner volume of the bellows) and/or configured to reciprocally expand/inflate and contract/deflate the bellows 330 based on movement of drive fluid 311 (sometimes termed power fluid). The bellows 330 may be configured to reciprocally expand and/or retract within the chamber 321 of the fluid end 320 based on movement of the drive fluid 311. In some embodiments, the bellows 330 may be sealingly coupled to an opening in the chamber 321 of the fluid end 320 (e.g. coupled to the wall of the chamber), so that fluid communication between the power end 310 and the bellows 330 causes reciprocal movement of the bellows 330 within the chamber 321. In some embodiments, the power end 310 may be (e.g. sealingly) coupled to the fluid end 320, with no flow of treatment fluid or drive fluid therebetween (e.g. since the bellows 330 separates the fluids).

In embodiments, the bellows 330 may comprise a flexible/expandable bag or body, typically of thin, flexible material, whose inner volume (e.g. the open space therein, which may be configured to hold drive fluid) can be changed (e.g. based on the amount/pressure of fluid therein). The bellows 330 may have an opening allowing fluid communication of drive fluid 311 with the power end 310, but in some embodiments may otherwise have a form configured to retain fluid therein. For example, the bellows 330 may be configured to prevent fluid transfer between its interior and the chamber 321 of the fluid end 320 external to the bellows 330. In some embodiments, the bellows 330 may comprise an elastomeric element and/or material. In some embodiments, the bellows 330 may comprise metal material and/or may include an accordion-like configuration (e.g. having pleats or folds or convolutions). In some embodiments, exemplary metal bellows may be formed of a metal that is sufficiently flexible and/or durable and configured appropriately to effectively withstand repeated back and forth motion due to reciprocal movement without breaking or wearing to failure for a reasonable life of the bellows. For example, the bellows may comprise stainless steel, nickel alloys such as Inconel & Monel, hastealloy, and/or copper alloys. In some embodiments, the bellows 330 may not be configured to withstand significant pressure differentials. In some embodiments, the bellows 330 may be configured to separate (e.g. isolate) drive fluid 311 (e.g. clean fluid) from treatment fluid (e.g. dirty fluid, such as fluid having proppant, abrasives, and/or corrosive materials, such as from treatment fluid source 350).

The bellows 330 may be disposed in and/or configured to expand into the chamber 321 of the fluid end 320, and may be configured to serve as a separating barrier that divides the chamber 321 into a first volume 373 within the bellows 330 and a second volume 375 outside of the bellows 330. The first volume 373 (e.g. inner volume of the bellows 330) may be in fluid communication with the power end 310, and may in some embodiments contain drive fluid. The second volume 375 of the chamber 321 is in fluid communication with the suction valve 326 and discharge valve 328, and is configured for treatment fluid to flow therethrough. The bellows 330 may serve as a fluid separating barrier between the drive fluid 311 in the first volume 373 and the treatment fluid in the second volume 375. The bellows 330 may be configured to flex (e.g. expand and/or contract) to balance pressure between the first volume 373 and second volume 375 during operation of the pump 300. In some embodiments, the bellows 330 may be configured to flex axially. The power end 310 of pump 300 may be sealingly connected to the fluid end 320, to prevent entry of treatment fluid from the fluid end 320 into the power end 310.

The chamber 321 may be downstream of the fluid treatment source 350 and upstream of the well 160. Typically, the suction valve 326 can be a one-way check valve configured to allow treatment fluid from the treatment fluid source 350 to enter the chamber 321 (e.g. during a suction stroke of the pump 300), and the discharge valve 328 can be a one-way check valve configured to allow treatment fluid to exit the chamber 321 towards the well (e.g. during a power/discharge stroke of the pump 300). The reciprocating expansion and retraction of the bellows 330 in the chamber 321 (e.g. with the bellows 330 expanding/inflating for the discharge stroke and contracting/deflating for the suction stroke) can be configured to work in conjunction with the suction valve 326 and discharge valve 328 to allow the fluid end 320 to pump treatment fluid into the well 160. For example, during a discharge stroke, as drive fluid 311 enters the first volume 373 (e.g. the inner volume of the bellows 330), the bellows 330 inflates and treatment fluid is expelled from the second volume 375 of the chamber 321 through the discharge valve 328. Once the discharge stroke is complete, a suction stroke can begin. During the suction stroke, drive fluid 311 inside the first volume 373 exits the bellows 330, the bellows 330 deflates, and treatment fluid can be drawn through the suction valve 326 into the second volume 375 of the chamber 321. Once the bellows 330 is compressed to its minimum desired/permitted length, another discharge stroke can begin.

The bellows 330 may be configured to separate treatment fluid, which the pump 300 may be pumping into the well 160, from drive fluid 311 used for pump operations. By way of example, the drive fluid 311 may be chosen from a desirable group of liquids, which may include hydraulic fluid such as water or hydraulic oil. In some embodiments, the drive fluid 311 may also serve as a lubricant for the pump 300, for example forming a barrier against wear due to friction. In the case of a fracturing operation or a fracturing pump, the treatment fluid may be a fracturing fluid that may comprise a base fluid (e.g., water, oils, organic liquids, etc.) as well as any other suitable components or additives useful for the fracturing treatment. For example, the fracturing fluid may be a slurry containing sand or synthetic proppants and/or a variety of chemical additives such as gelling agents, acids, friction reducers, and solvents.

In various embodiments, any mechanism for causing reciprocal movement of the bellows 330 (e.g. by movement of the drive fluid 311) can provide the pumping action for the pump 300. In some embodiments, the power end 310 may further comprise a piston or plunger 410 configured to reciprocally move drive fluid 311 (e.g. in and out of the bellows 330). See for example FIG. 4, which schematically illustrates an embodiment of the bellows pump 300 having a piston/plunger 410. Reciprocal movement (e.g. axial translation) of the piston/plunger 410 within a bore 420 of the power end housing 413 may cause the reciprocal movement (e.g. expanding and contracting) of the bellows 330 (e.g. within the chamber 321 of the fluid end 320), for example with the piston/plunger 410 displacing fluid (e.g. hydraulic drive fluid 311) which is located in the bore 420 between the driven end of the piston/plunger 410 (e.g. the end in proximity to the bellows 330) and the bellows 330. Since the bore 420 is fluidly coupled to (e.g. in fluid communication with) the bellows 330, the piston/plunger 410 reciprocally displacing drive fluid 311 can induce reciprocal movement (e.g. expansion and contraction) of the bellows 330. As used herein, reference to "piston" shall include both conventional piston and plunger elements for convenience of reference.

Figure 4:
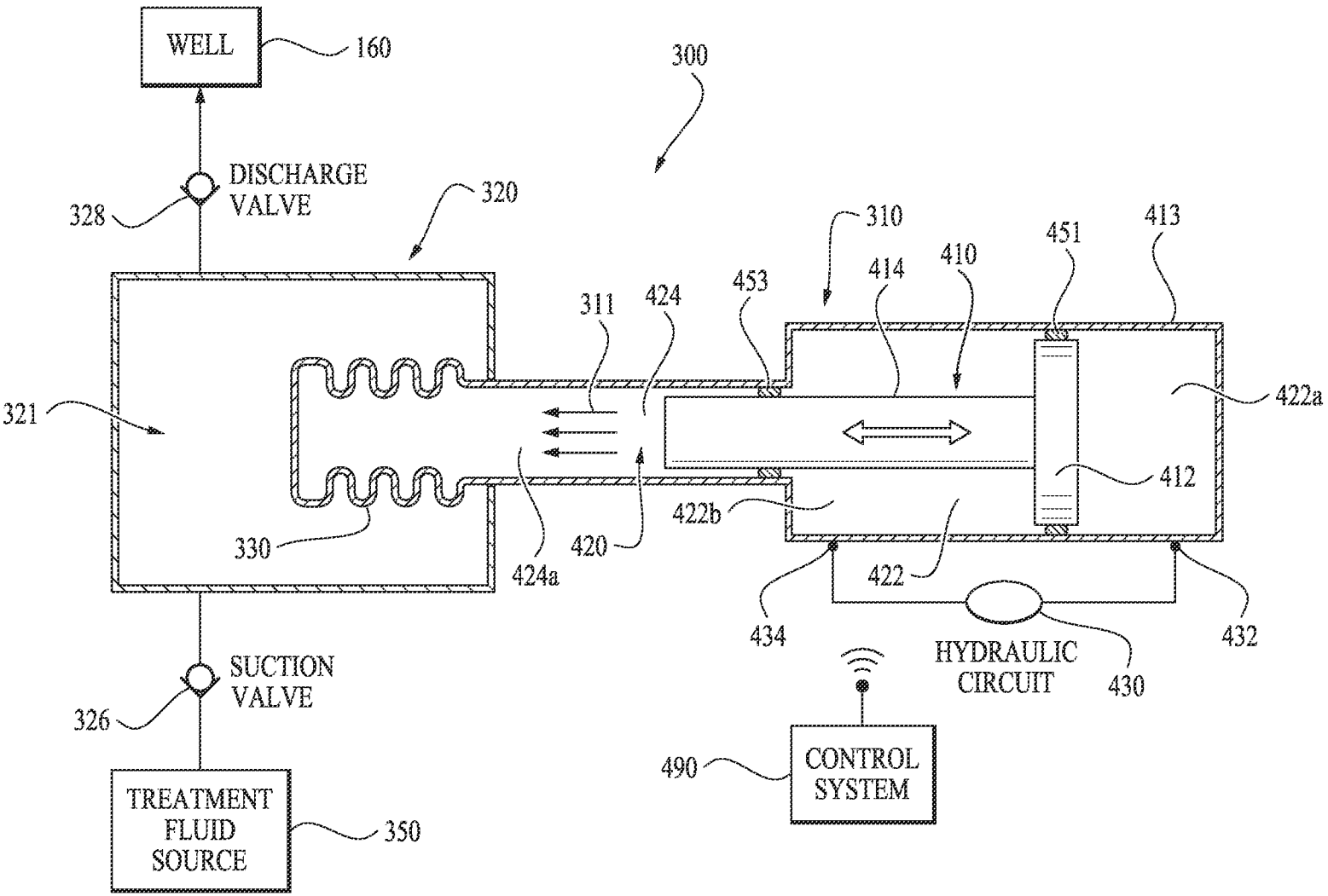
FIG. 4 is a schematic illustration of an exemplary bellows pump with piston/plunger, according to an embodiment of the disclosure.

In embodiments, the piston 410 may be configured to sealingly move within the bore 420, for example having one or more seal (configured to engage between the piston 410 and the bore 420) disposed on the piston 410 and/or on the inner wall of the bore 420. In some embodiments, one or more seal may comprise pump packing. In some embodiments, the bellows 330 may be configured to protect the piston 410 from wear, for example by separating the piston 410 from the treatment fluid in the fluid end 320. In some embodiments, the piston 410 may be configured so that, during its reciprocal movement in the bore 420, the piston 410 does not extend into the inner volume of the bellows 330; while in other embodiments, the piston 410 may be configured to extend partially into the bellows during a discharge stroke. Regardless, the piston 410 may be configured to not contact the bellows 330 (e.g. the end of the bellows) during its reciprocal movement. The piston 410 can be driven/powered by any suitable means, including various types of driver elements configured to induce reciprocal movement of the piston 410, such as a hydraulic circuit, a combustion engine, an electric motor, a linear actuator, rack and pinion, diesel, electric driven, etc. In the example of FIG. 4, the piston 410 may be driven by a hydraulic circuit 430. In other exemplary embodiments, the pump 300 may be powered by natural gas (e.g. via a natural gas-fired engine or natural gas-fired electric generator) produced from the same area in which well treatment (e.g. fracturing) operations are being performed. In some embodiments, a control system 490 may control one or more aspect of the driver (e.g. to control the reciprocation of the piston 410 and thereby the bellows 330) and/or the valves (e.g. 326, 328).

In some embodiments, the piston 410 can comprise a head 412 and a rod 414 (e.g. with the rod 414 disposed between the head 412 and the bellows 330, and extending from the head 412 towards the fluid end 320). In some embodiments, the piston 410 can be driven by a hydraulic circuit 430. For example, the hydraulic circuit 430 of the power end 310 can include a first port 432, located such that the head 412 is disposed between the first port 432 and the rod 414, and a second port 434 located between the head 412 and the bellows 330 (e.g. more proximate the bellows 330 than the first port 432). In some embodiments, the hydraulic circuit 430 may include one or more source of drive fluid and/or one or more pump. For example, the first port 432 may be in fluid communication with a source of drive fluid and/or a pumping mechanism. In some embodiments, the second port 434 may be in fluid communication with a source of drive fluid and/or a pumping mechanism. In some embodiments, the source of drive fluid may be the same for the first port 432 and the second port 434. In some embodiments, the pumping mechanism may be the same for the first port 432 and the second port 434. In some embodiments, the hydraulic circuit 430 may include one or more valve. The hydraulic circuit 430 may be configured to produce pressure differential on either side of the piston 410 (e.g. the head 412), for example by introducing drive fluid (such as hydraulic oil) via the ports (432, 434), which may induce movement/displacement of the piston 410. For example, introducing drive fluid via the first port 432 and/or removing drive fluid via the second port 434 may urge extension of the piston 410 towards the fluid end 320, while introducing drive fluid via the second port 434 and/or removing drive fluid via the first port 432 may retract the piston 410, urging the piston 410 away from the fluid end 320.

While the rod 414 and head 412 may have a similar diameter in some embodiments, in some embodiments the rod 414 may have a smaller diameter than the head 412. The ratio of size differential between the rod 414 and the head 412 can provide an intensifying effect, in which pressure applied to the head 412 is multiplied/increased as applied to the bellows 330 (via the rod 414). For example, the piston 410 may be part of an intensifier configured to intensify applied pressure (e.g. from the driver) to the bellows 330 (e.g. with the rod 414 having a smaller diameter than the head 412). For example, the size difference/ratio between the diameter of the rod 414 and the head 412 may range from approximately 1:1.1 to 1:10 (e.g. from 1:1.5 to 1:10, from 1:2 to 1:10, from 1:3 to 1:10, from 1:5 to 1:10, from 1:7 to 1:10, from 1:1.5 to 1:8, from 1:1.5 to 1:5, from 1:1.5 to 1:3, from 1:2 to 1:8, from 1:2 to 1:5, from 1:2 to 1:3, from 1:3 to 1:10, from 1:3 to 1:8, or from 1:3 to 1:5).

As described above, the power end 310 may include a bore 420 (e.g. in a power end housing 413) in fluid communication with (e.g. fluidly coupled to) the bellows 330 (e.g. an internal volume of the bellows), and the piston 410 can be disposed within the bore 420. In embodiments (e.g. in which the piston 410 is not uniform in diameter along its length), the bore 420 may have a first portion 422 with an inner diameter configured for movement of the head 412 (axially) therethrough and a second portion 424 with an inner diameter configured for movement of the rod 414 (axially) therethrough. For example, the first portion 422 of the bore may have a diameter approximately equal to that of the head 412, while the second portion 424 of the bore may have a diameter approximately equal to that of the rod 414 (e.g. the first portion 422 of the bore may have a larger diameter than the second portion 424 of the bore). In embodiments, the head 412 may separate the first portion 422 of the bore 420 into two cavities (whose volumes may change based on the position of the head 412 within the bore 420), for example with a first cavity 422*a* distally away from the fluid end 320 and/or bellows 330 (e.g. with the head 412 disposed between the first cavity 422*a* and the bellows 330) and a second cavity 422*b* more proximal to the bellows 330 and/or fluid end 320 (e.g. with the second cavity 422*b* disposed between the head 412 and the bellows 330). Interaction of the rod 414 within the second portion 424 of the bore 420 may form a third cavity 424*a* in fluid communication with the bellows 330. In embodiments having a hydraulic circuit as the driver (e.g. as shown in FIG. 4), the first port 432 may be in fluid communication with the first cavity 422*a*, and the second port 434 may be in fluid communication with the second cavity 422*b*. The third cavity 424*a* may be in fluid communication with the bellows 330. Typically, the bore 420 may extend along the longitudinal axis of the power end 310 and/or parallel to the longitudinal axis (e.g. the axis of extension) of the bellows 330.

In operation, the head 412 of the piston 410 may be configured to sealingly move within the first portion 422 of the bore 410 (e.g. during pump strokes), and the rod 414 may be configured to sealingly move within the second portion 424 of the bore 420 (e.g. during pump strokes). In embodiments, the power end 310 may further comprise a first seal 451 configured to seal the head 412 with respect to the first portion 422 of the bore 420 (e.g. such that the head 412 and first seal 451 isolate the first cavity 422*a* from the second cavity 422*b*) and a second seal 453 configured to seal the rod 414 with respect to the second portion 424 of the bore 420 (e.g. such that the rod 414 and second seal 453 isolate the third cavity 424*a* from the second cavity 422*b*). For example, the first seal 451 may be disposed on the head 412 (e.g. a moving seal), such as within one or more groove configured to hold a gasket, or on the bore first portion 422 inner surface (e.g. a stationary seal) and/or the second seal 453 may be disposed on the rod 414 (e.g. a moving seal) or on the bore second portion 424 inner surface (a stationary seal). In some embodiments, the first seal 451 may be a moving seal (e.g. disposed on the head 412) and the second seal 453 may be a stationary seal (e.g. disposed on the inner surface/wall of the bore 420—e.g. within the bore second portion 424—which may in some embodiments comprises pump packing). In some embodiments, one or more stationary seal may be configured to prevent fluid flow between the second portion 424 of the bore and the first portion 422 of the bore and/or to provide a controlled volume of fluid for interaction with the inner volume of the bellows 330. While the discussion has been set forth with regard to a pump 300 having a single bellows 330, similar concepts apply for dual (e.g. double-acting) bellows pumps (e.g. in which a single piston interacts with two bellows, for example such that the discharge stroke for one bellows is the suction stroke for the other).

It can be important for the health of the bellows pump 300 (e.g. to protect the bellows 330 from excessive pressure differentials which could damage the bellows 330) to ensure that the bellows 330 and the piston 410 remain in sync (e.g. with the bellows 330 not exceeding its full permissible extension position when the piston 410 is at its maximum extension at the end of the discharge stroke, and the bellows 330 not exceeding its permissible contraction position when the piston 410 is at its most retracted position at the end of its suction stroke). To aid in maintaining such synchronization between the bellows 330 and the piston 410, the volume of fluid between the rod 414 and the bellows 330 may be maintained at approximately a constant volume. Leaks in the bellows 330 can prove problematic, affecting the amount of sync and potentially damaging the bellows 330. For example, a bellows 330 leak can cause a pressure imbalance between the drive fluid in the bellows 330 and the treatment fluid in the chamber 321, which may damage (e.g. crush) the bellows 330.

Figure 5:
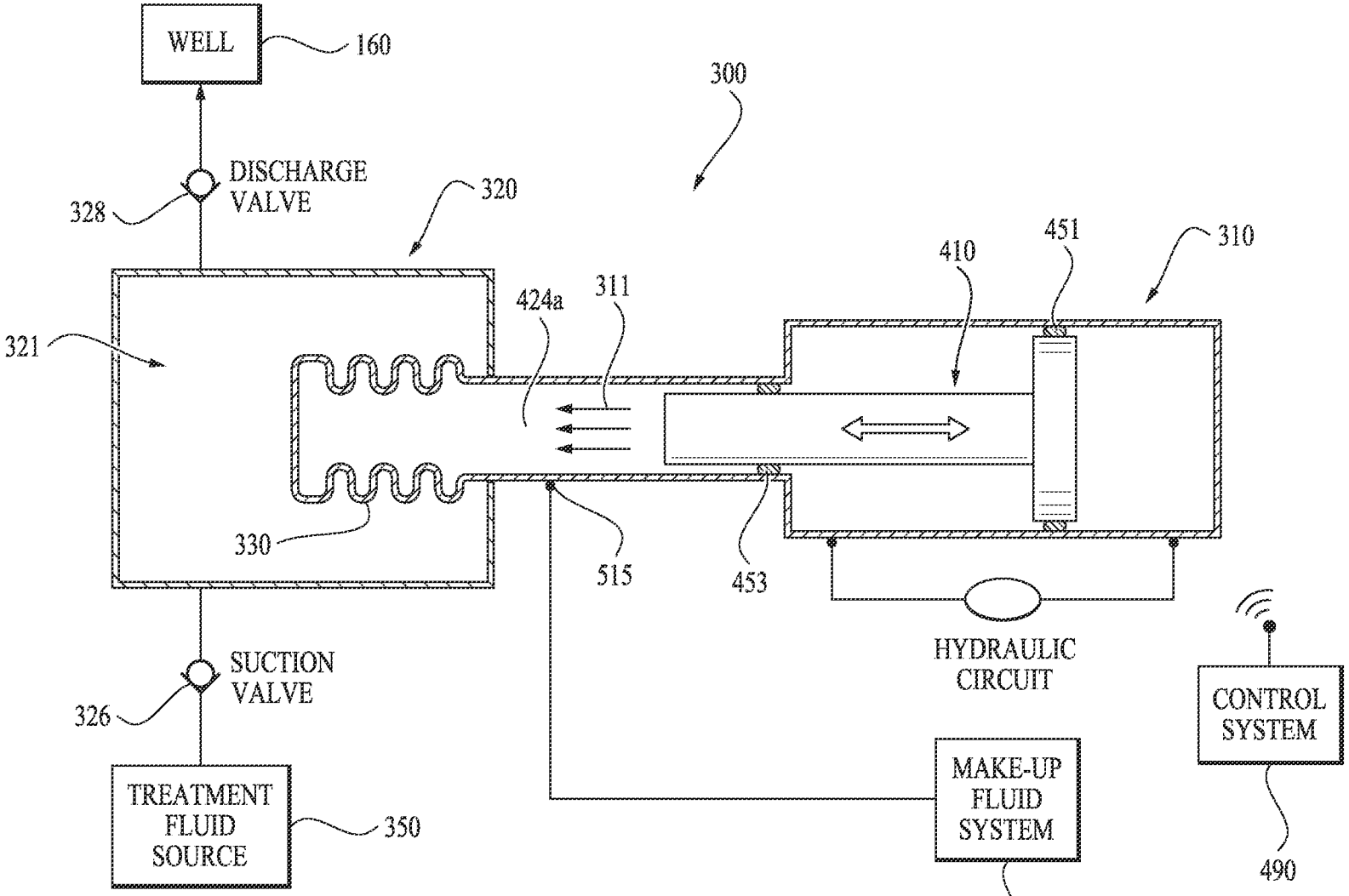
FIG. 5 is a schematic illustration of an exemplary system for providing make-up fluid to an exemplary bellows pump, according to an embodiment of the disclosure.

In order to address any such leak, a make-up system 510 (e.g. as shown schematically with an embodiment of pump 300 in FIG. 5) can be configured to correct/maintain a controlled volume of fluid in the space between the rod 414 and the bellows 330 (for example by injecting make-up fluid, which typically is drive fluid, into the space between the rod 414 and the bellows 330—e.g. into the controlled volume formed by the rod seal 453, such as the third cavity 424*a*), in order to maintain synchronization between the bellows 330 and the piston 410. For example, the power end 310 may include a make-up port 515 (e.g. a third port), which may be in fluid communication with the second portion 424 of the bore 420 (e.g. the third cavity 424*a* between the rod 414 and/or rod seal 453 and the bellows 330). While the make-up port 515 is shown with respect to the power end 310 in FIG. 5, in other embodiments, the make-up port 515 may be disposed in the fluid end 320.

A source of make-up fluid may be in fluid communication with the make-up port 515, and the make-up system 510 may further comprise one or more make-up valve configured to open (to provide fluid communication therethrough) and close (to prevent fluid communication therethrough and/or isolate the make-up system 510 from the bellows 330). In some embodiments the make-up system 510 may include a make-up pump, which may be configured to pump make-up fluid from the make-up fluid source into the second portion 424 of the bore 420 through the make-up port 515. The control system 490 in some embodiments may be used to operate the make-up system 510, for example opening and closing the make-up valve and/or operating the make-up pump. In some embodiments, the control system 490 may comprise and/or communicate with one or more sensors, whose data the control system 490 can use to determine if the bellows 330 and piston 410 are out of sync and to operate the make-up system 510 to bring the bellows 330 and piston 410 back into sync. For example, the control system 490 may open the make-up valve and activate the make-up pump to inject make-up fluid into cavity 424*a* and/or to draw make-up fluid out of cavity 424*a* via make-up port 515, in order to bring the bellows 330 and the piston 410 back into sync.

In some embodiments, the pump 300 may be one of a plurality of similar pumps which may be configured to operate together/concurrently (e.g. configured to jointly pump fluid in the well 160 and/or which are jointly driven and/or which share a common drive fluid source and/or make-up fluid source and/or which are jointly controlled). For example, the plurality of pumps 330 may share a common source for treatment fluid, drive fluid, and/or make-up fluid. In some embodiments, the drive fluid and the make-up fluid may be drawn from a common fluid source (e.g. drive fluid and make-up fluid may be substantially the same). In some embodiments, the plurality of pumps 330 can share a common driver. In some embodiments, the plurality of pumps 330 may share a common control system 490. In some embodiments, one or more of the plurality of pumps 330 may be configured to be out-of-sync with one or more other of the plurality of pumps 330 (for example with a first pump undergoing a discharge stroke while a second pump undergoes a suction stroke). In some embodiments, having pumps of the plurality of pumps 330 out-of-sync with each other may allow for continuous pumping of treatment fluid (e.g. under approximately constant pressure). In some embodiments, a first half of the plurality of pumps may be in sync with each other, while a second half of the plurality of pumps may be in sync with each other but out of sync with the first half. In some embodiments, the plurality of pumps may comprise at least two dissimilar pumps.

Some embodiments may include a control system 490, which may be configured to monitor and/or control one or more aspects of the bellows pump 300 and/or related treatment system 100 (e.g. a system including at least one bellows pump 300). The control system 490 may include an information handling system (e.g. comprising one or more processor) and/or may be configured to receive data from one or more sensor configured to monitor/detect one or more parameters of the system. In some embodiments, the parameters monitored may include pressure, temperature, flow rate, viscosity, contamination/particle count, strain, valve position, piston position, and/or bellows position. In some embodiments, vibration and/or acoustics could be sensed (e.g. to give a general idea that something may be wrong in the system, for example in the fluid chamber). Hydraulic gain control would also pick up something is wrong in the system. Data from the sensor(s) may be transmitted to and/or received by the information handling system, for example with the control system 490 using the data to monitor and/or control one or more aspect of the bellows pump 300 and/or system 100. In embodiments, the control system 490 may be configured to communicate with sensors and/or other components of the pump or system wirelessly and/or via wired connection.

Figure 6:
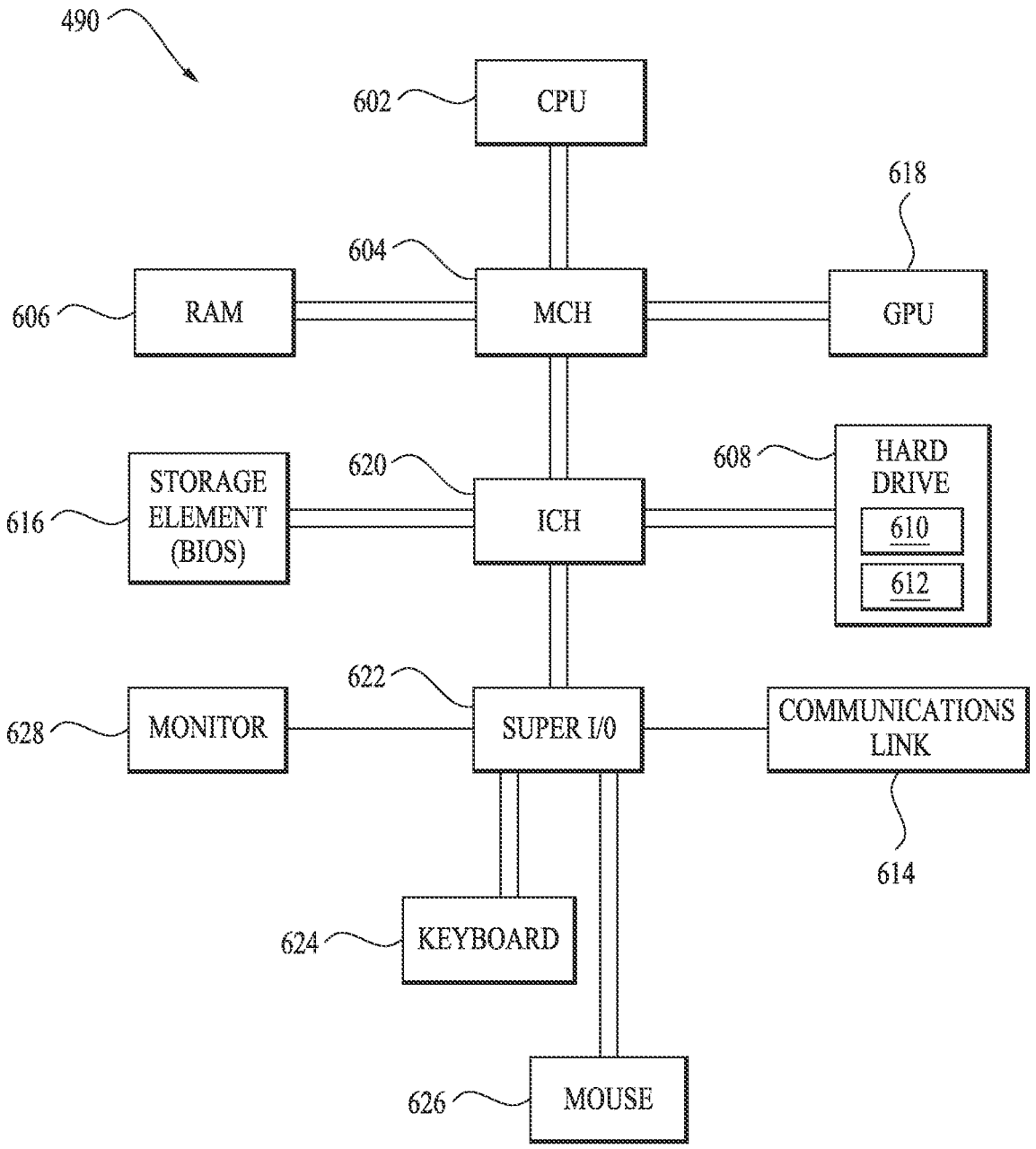
FIG. 6 is a schematic illustration of an exemplary control system, which may be used in conjunction with a bellows pump system, according to an embodiment of the disclosure.

FIG. 6 is a schematic diagram illustrating an exemplary information handling system/control system 490, for example for use with or by an associated treatment system 100 of FIG. 1, according to one or more aspects of the present disclosure. A processor or central processing unit (CPU) 602 of the control system 490 is communicatively coupled to a memory controller hub (MCH) or north bridge 604. The processor 602 may include, for example a microprocessor, microcontroller, digital signal processor (DSP), application specific integrated circuit (ASIC), or any other digital or analog circuitry configured to interpret and/or execute program instructions and/or process data. Processor 602 may be configured to interpret and/or execute program instructions or other data retrieved and stored in any memory (which may for example be a non-transitory computer-readable medium, configured to have program instructions stored therein, or any other programmable storage device configured to have program instructions stored therein) such as memory 606 or hard drive 608. Program instructions or other data may constitute portions of a software or application, for example application 610 or data 612, for carrying out one or more methods described herein. Memory 606 may include read-only memory (ROM), random access memory (RAM), solid state memory, or disk-based memory. Each memory module may include any system, device or apparatus configured to retain program instructions and/or data for a period of time (for example, non-transitory computer-readable media). For example, instructions from a software or application 610 or data 612 may be retrieved and stored in memory 606 for execution or use by processor 602. In one or more embodiments, the memory 606 or the hard drive 608 may include or comprise one or more non-transitory executable instructions that, when executed by the processor 602, cause the processor 602 to perform or initiate one or more operations or steps. The information handling system 600 may be preprogrammed or it may be programmed (and reprogrammed) by loading a program from another source (for example, from a CD-ROM, from another computer device through a data network, or in another manner).

The data 612 may include treatment data, geological data, fracture data, microseismic data, sensor data, or any other appropriate data. In one or more embodiments, the data 612 may include treatment data relating to fracture treatment plans. For example, the treatment data may indicate a pumping schedule, parameters of a previous injection treatment, parameters of a future injection treatment, or one or more parameters of a proposed injection treatment. Such one or more treatment parameters may include information on flow rates, flow volumes, slurry concentrations, fluid compositions, injection locations, injection times, or other parameters. The treatment data may include one or more treatment parameters that have been optimized or selected based on numerical simulations of complex fracture propagation. In one or more embodiments, the data 612 may include geological data relating to one or more geological properties of the subterranean formation 202 (referring to FIG. 2). For example, the geological data may include information on the wellbore 204 (referring to FIG. 2), completions, or information on other attributes of the subterranean formation 202. In one or more embodiments, the geological data may include information on the lithology, fluid content, stress profile (e.g., stress anisotropy, maximum and minimum horizontal stresses), pressure profile, spatial extent, or other attributes of one or more rock formations in the subterranean zone. The geological data may include information collected from well logs, rock samples, outcroppings, microseismic imaging, or other data sources. In one or more embodiments, the data 612 may include fracture data relating to fractures in the subterranean formation 202. The fracture data may identify the locations, sizes, shapes, and other properties of fractures in a model of a subterranean zone. The fracture data may include information on natural fractures, hydraulically-induced fractures, or any other type of discontinuity in the subterranean formation 202. The fracture data may include fracture planes calculated from microseismic data or other information. For each fracture plan, the fracture data may include information (for example, strike angle, dip angle, etc.) identifying an orientation of the fracture, information identifying a shape (for example, curvature, aperture, etc.) of the fracture, information identifying boundaries of the fracture, or any other suitable information.

In embodiments, the sensor data may include data measured/detected by one or more sensors, for example with relation to one or more aspect of the pump 300 and/or the system 100. For example, the sensor data may include pressure (e.g. at the fluid end 320 and/or the power end 310), temperature (e.g. at the fluid end 320 and/or power end 310 and/or make-up system 510), flow rate (e.g. within the fluid end 310 and/or hydraulic circuit 430 and/or the make-up system 510), viscosity (e.g. of treatment fluid in the fluid end 320 and/or drive fluid in the power end 310), contamination/particle count (e.g. at the fluid end 320 and/or power end 310 and/or in the make-up system 510), strain (e.g. at the fluid end 320 and/or power end 310), suction valve 326 and/or discharge valve 328 position, piston position, and/or bellows position. Data received by the control system 490 (e.g. from one or more sensors) may be used to carry out operations with respect to the pump 300 and/or system 100. For example, the control system 490 may evaluate the data and determine one or more action based on the evaluation. In some embodiments, the control system 490 may automatically take action based on the evaluation.

The one or more applications 610 may comprise one or more software applications, one or more scripts, one or more programs, one or more functions, one or more executables, or one or more other modules that are interpreted or executed by the processor 602. For example, the one or more applications 610 may include a fracture design module, a reservoir simulation tool, a hydraulic fracture simulation model, or any other appropriate function block. The one or more applications 610 may include machine-readable instructions for performing one or more of the operations related to any one or more embodiments of the present disclosure. The one or more applications 610 may include machine-readable instructions for generating a user interface or a plot, for example, illustrating fracture geometry (for example, length, width, spacing, orientation, etc.), pressure plot, hydrocarbon production performance, pump performance. The one or more applications 610 may obtain input data, such as treatment data, geological data, fracture data, or other types of input data, from the memory 606, from another local source, or from one or more remote sources (for example, via the one or more communication links 614). The one or more applications 610 may generate output data and store the output data in the memory 606, hard drive 608, in another local medium, or in one or more remote devices (for example, by sending the output data via the communication link 614).

Memory controller hub 604 may include a memory controller for directing information to or from various system memory components within the information handling system 600, such as memory 606, storage element 616, and hard drive 608. The memory controller hub 604 may be coupled to memory 606 and a graphics processing unit (GPU) 618. Memory controller hub 604 may also be coupled to an I/O controller hub (ICH) or south bridge 620. I/O controller hub 620 is coupled to storage elements of the information handling system 600, including a storage element 616, which may comprise a flash ROM that includes a basic input/output system (BIOS) of the computer system. I/O controller hub 620 is also coupled to the hard drive 608 of the information handling system 600. I/O controller hub 320 may also be coupled to an I/O chip or interface, for example, a Super I/O chip 622, which is itself coupled to several of the I/O ports of the computer system, including a keyboard 624, a mouse 626, a monitor (or other display) 628 and one or more communications link 614. Any one or more input/output devices receive and transmit data in analog or digital form over one or more communication links 614 such as a serial link, a wireless link (for example, infrared, radio frequency, or others), a parallel link, or another type of link. The one or more communication links 614 may comprise any type of communication channel, connector, data communication network, or other link. For example, the one or more communication links 614 may comprise a wireless or a wired network, a Local Area Network (LAN), a Wide Area Network (WAN), a private network, a public network (such as the Internet), a WiFi network, a network that includes a satellite link, or another type of data communication network.

Modifications, additions, or omissions may be made to FIG. 6 without departing from the scope of the present disclosure. For example, FIG. 6 shows a particular configuration of components of control system 490. However, any suitable configurations of components may be used. For example, components of control system 490 may be implemented either as physical or logical components. Furthermore, in some embodiments, functionality associated with components of control system 490 may be implemented in special purpose circuits or components. In other embodiments, functionality associated with components of control system 490 may be implemented in configurable general-purpose circuit or components. For example, components of control system 490 may be implemented by configured computer program instructions.

In a bellows-style pump, effectively addressing leakage of treatment fluid into the bellows can be important, for example for pump durability, reliability, maintenance, and life. When operating correctly, the bellows of the pump will segregate the treatment fluid being pumped by the pump (e.g. through the chamber of the fluid end) from the drive fluid used by the power end of the pump (e.g. to provide pumping operation of the bellows and/or piston). However, damage and/or wear of the bellows may occur over time, given the difficult operating conditions for such pumps (e.g. the abrasive and/or acidic/corrosive nature of treatment fluid and/or the high pressures experienced by the pump). Such damage and/or wear of the bellows may allow the high-pressure pumped treatment fluid to leak through the barrier provided by the bellows, potentially entering the bellows and thereby causing contamination of the drive fluid of the power end of the bellows pump (which could, in turn, cause further damage to the pump, including one or more seal in the power end).

Concerns about such pump damage may be even greater in bellows pump systems having a make-up system. It can be important to prevent any leakage of treatment fluid into the bellows from spreading to the make-up system, since introduction of treatment fluid into the make-up system may damage the make-up system, requiring still further costly repairs. This issue may be even more critical in bellows pump systems in which the make-up fluid is shared by (e.g. in fluid communication with) one or more other/additional components of the bellows pump system, since those other components would also be prone to damage from introduction of treatment fluid. Thus, there is a need for improved bellows pump systems which can minimize potential damage due to leakage of treatment fluid into the bellows.

Figure 3:
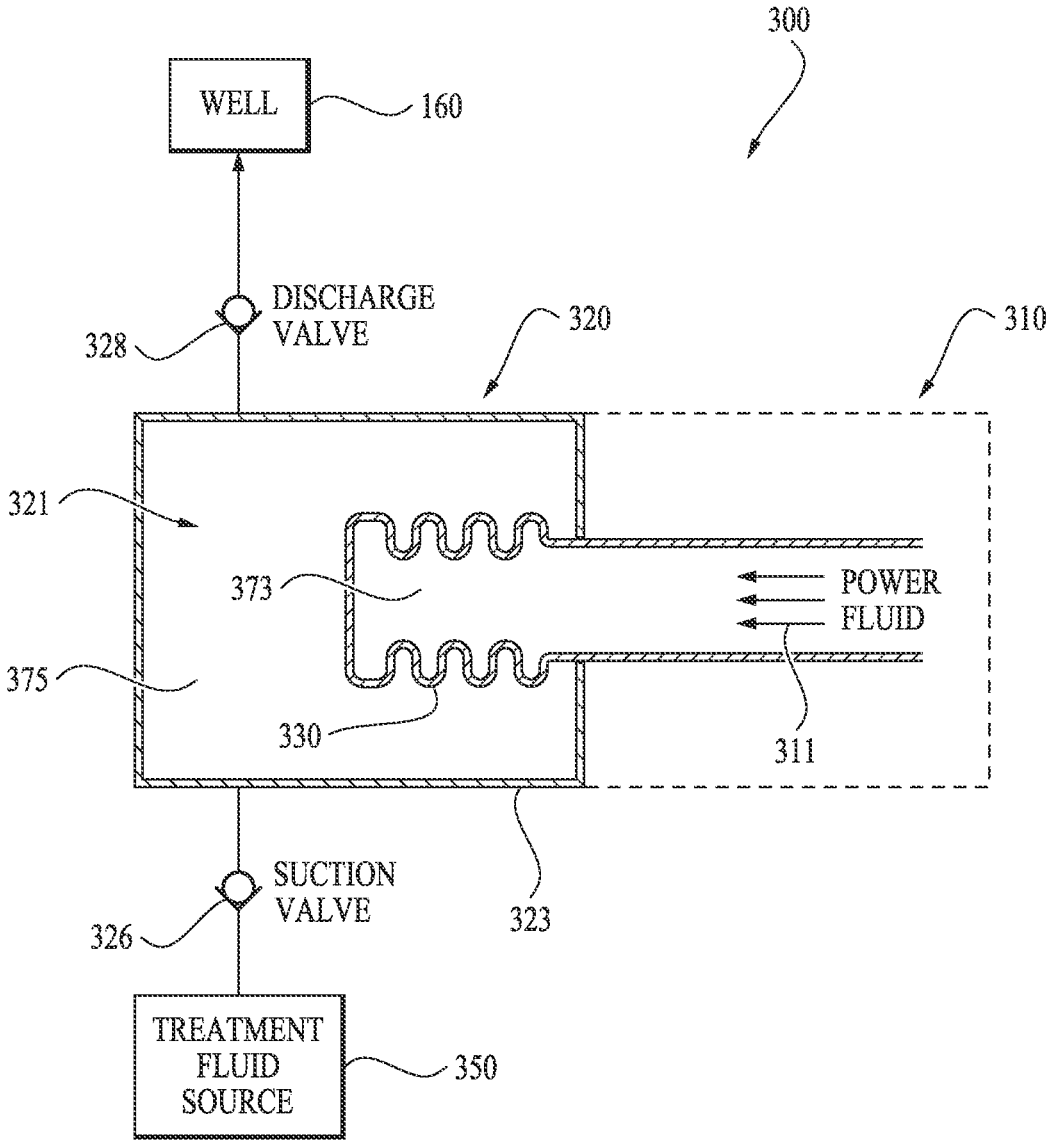
FIG. 3 is a schematic illustration of an exemplary bellows pump, according to an embodiment of the disclosure.
Figure 7:
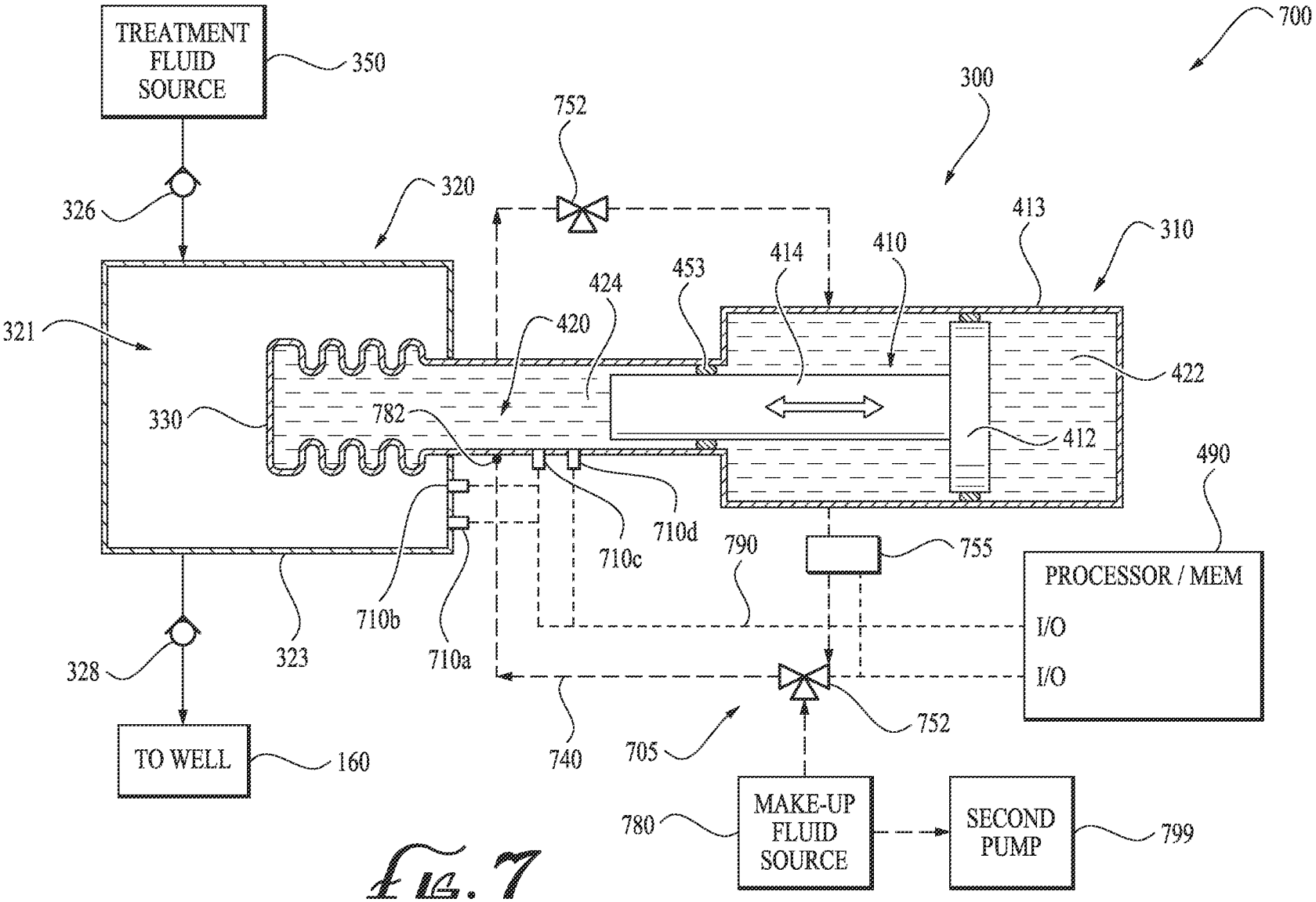
FIG. 7 is a schematic illustration of an exemplary bellows pump system having a make-up system, according to an embodiment of the disclosure.
Figure 8:
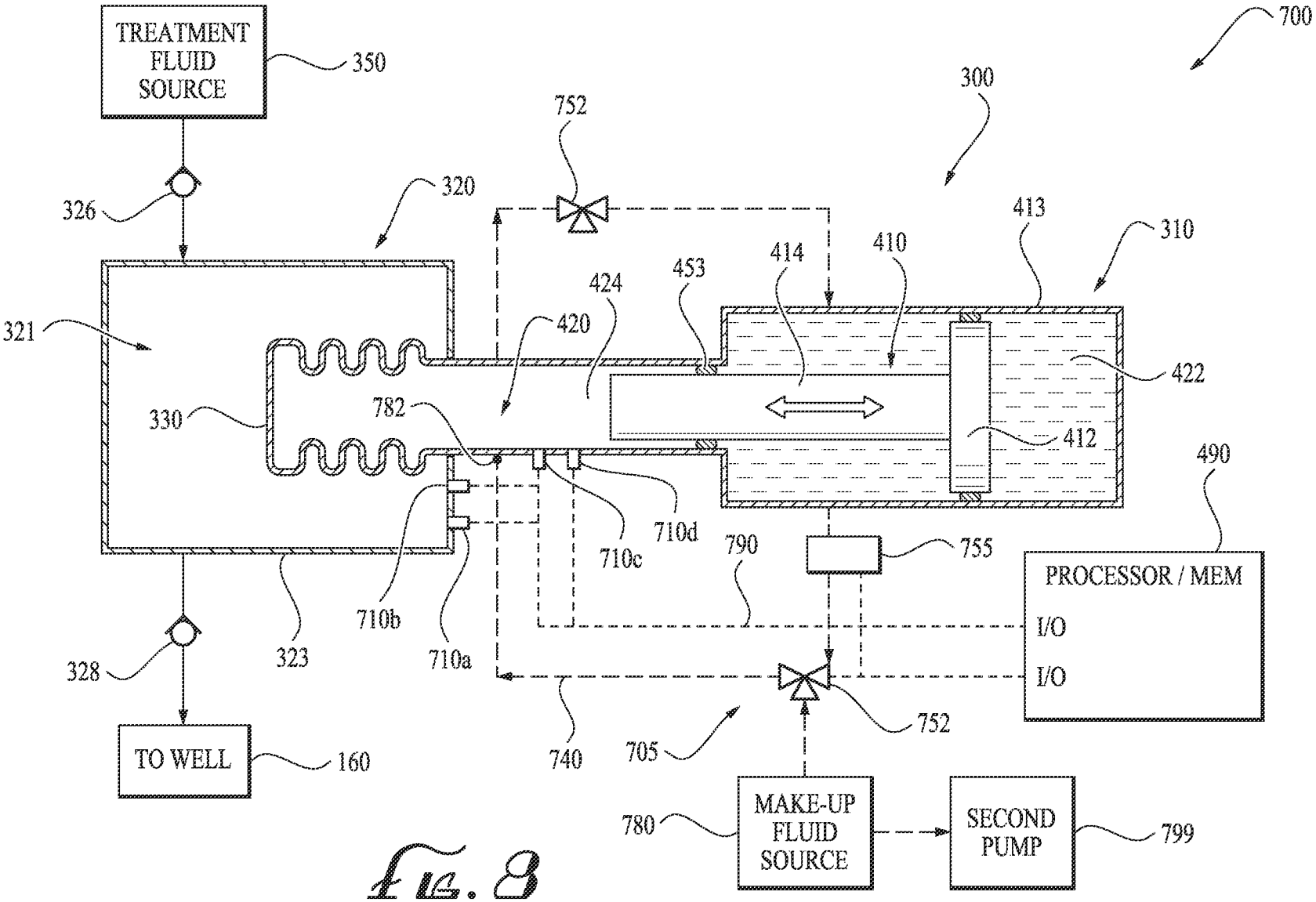
FIG. 8 is a schematic illustration of the exemplary bellows pump system of FIG. 7, illustrating a leak in the bellows, according to an embodiment of the disclosure.

FIGS. 7-8 provide schematic illustration of an exemplary bellows pump system 700 embodiment having a bellows pump 300 similar to the pump embodiments shown in FIGS. 3-5, and having a make-up system 510 which can be configured to prevent or minimize any contamination within the bellows 330 (e.g. of treatment fluid entering the bellows) from spreading to, compromising, and/or damaging other components of the system 700 which may be in fluid communication with the make-up system 510. FIG. 7 illustrates the bellow pump 300 while it is in good health (e.g. when there is no leakage of treatment fluid into the bellows 330 from the chamber 321) and/or is configured for pumping operation (e.g. with make-up and/or drive fluid disposed between the bellows 330 and the piston 410). Typically, the make-up and/or drive fluid disposed between the bellows 330 and the piston 410 may be the same fluid as the drive fluid disposed in the intensifier (e.g. between the seal 453 and the head 412 of the piston 410 and/or behind the head 412 of the piston). FIG. 8 illustrates the bellows pump 300 after there has been leakage of treatment fluid into the bellows 330 (e.g. such that the fluid between the bellows 330 and the piston 410 is contaminated with treatment fluid). In FIG. 8, the seal (e.g. second 453) may separate the contaminated fluid (e.g. having treatment fluid therein) from the clean drive fluid. In FIG. 8, the seal 453 has not yet been compromised by the treatment fluid (despite exposure due to bellows failure/leakage), such that the fluid in the intensifier (e.g. the fluid surrounding the head 412 of the piston 410) is still clean drive fluid, while the fluid between the bellows 330 and the seal 453 is dirty fluid (e.g. contaminated with treatment fluid).

In FIGS. 7-8, the system 700 may comprise a source of treatment fluid 350, a bellows pump 300 in fluid communication with the source of treatment fluid 350 and/or configured to pump treatment fluid into the well, a make-up system 510, and a control system 490 having one or more sensor 710 (e.g. configured to detect one or more parameters of the system 700). In embodiments, the bellows pump 300 may include a power end 310 comprising a piston 410 (e.g. of an intensifier) configured to reciprocally move make-up/drive fluid (e.g. in and out of the bellows 330); a fluid end 320 having a fluid end housing 323 with a chamber 321, a suction valve 326 (e.g. in fluid communication with (e.g. fluidly coupled to) the chamber 321 and a source for the treatment fluid 350 and/or configured for introduction of treatment fluid into the chamber 321), and a discharge valve 328 (e.g. in fluid communication with (e.g. fluidly coupled to) the chamber 321 and the well and/or configured for injection of treatment fluid from the chamber 321 into a well); and an expandable bellows 330. In embodiments, the power end 310 can be (e.g. fluidly connected to and) configured to reciprocally expand/inflate and contract/deflate the bellows 330 based on movement of make-up/drive fluid, and the bellows 330 can be configured to expand within the chamber 321 of the fluid end 320 based on movement of the make-up/drive fluid.

In embodiments, the make-up system 510 may be configured to maintain a controlled volume of fluid (e.g. make-up and/or drive fluid) between the piston 410 and the 330 bellows (e.g. to keep the bellows 330 and piston 410 in sync). The make-up system 510 may comprise a make-up fluid source 780 fluidly coupled to the bellows 330 and at least one other/additional component of the system 700. The control system 490 may be configured to receive data from the one or more sensor 710, to evaluate the sensor data to detect a leak (e.g. of treatment fluid into the bellows 330, which could contaminate the make-up fluid source 780), and responsive to detecting a leak, to fluidly isolate the make-up system 510 (e.g. the make-up fluid source 780) from the bellows 330. In embodiments, fluidly isolating the make-up system 510 from the bellows 330 may act to simultaneously fluidly uncouple the at least one additional component of the system 700 from the bellows, thereby preventing the spread of any contamination (e.g. treatment fluid) entering the bellows 330 to any additional component of the system 700. In embodiments, the control system 490 may also be configured to evaluate the sensor data to determine whether the bellows 330 and piston 410 are out of sync, and responsive to determining that the bellows 330 and piston 410 are out of sync, using the make-up system 510 to adjust the amount of fluid (e.g. injecting and/or removing make-up/drive fluid) between the piston 410 and the bellows 330 to return the piston 410 and bellows 330 to sync.

In embodiments, the one or more sensor 710 can be configured to detect one or more of the following parameters at one or more location within the system 700: pressure, temperature, flow rate, viscosity, contamination (e.g. particle count), and/or position of one or more component of the system. For example, the one or more sensor 710 may detect position of the bellows 330 relative to position of the piston 410, pressure in the chamber 321 relative to pressure in the bellows 330, flow rate of treatment fluid through the suction valve 326 relative to flow rate if treatment fluid through the discharge valve 328, flow rate of make-up/drive fluid through the (e.g. one or more) make-up port 515 (e.g. in and out) of the bellows 330, flow rate of make-up fluid/drive fluid (e.g. configured to drive the piston 410) into and out of the intensifier (e.g. the first portion 422 of the bore 420 of the power end 310), flow rate of make-up/drive fluid into and out of the make-up fluid source 780, viscosity of fluid in the bellows 330, contamination (e.g. particle count) within the bellows 330, and/or temperature of make-up/drive fluid within the bellows 330 (e.g. compared to expected temperature and/or compared to temperature in the chamber 321). In embodiments, the one or more sensor may comprise a first sensor 710*a* configured to monitor one or more parameter within the chamber 321, a second sensor 710*b* configured to monitor one or more parameter in the bellows 330, a third sensor 710*c* configured to monitor one or more parameter of the make-up fluid system 510 (e.g. one or more parameter of the make-up/drive fluid entering and/or leaving the bellows 330 (e.g. through the make-up port 515)), and/or a fourth sensor 710*d* configured to monitor one or more parameter relating to the piston 410, intensifier, and/or power end 310.

In embodiments, the control system 490 may detect a leak based on the sensor data by comparing sensor data to a corresponding threshold. In some embodiments, the corresponding threshold can be pre-set and/or pre-selected. In some embodiments, the corresponding threshold can be based on historical data. In some embodiments, the corresponding threshold can be dynamically determined. For example, the corresponding threshold may be based on statistical deviation from sensor data across a plurality of cycles of the pump 300 (e.g. a pre-set timeframe, such as one minute, or cumulative data for the life (or some portion of the life) of the pump 300).

The suction valve 326 in some embodiments can be a one-way check valve configured to allow treatment fluid from the treatment fluid source to enter the chamber 321 (e.g. during a suction stroke of the pump 300) (e.g. while preventing treatment fluid from exiting the chamber 321 therethrough), and the discharge valve 328 can be a one-way check valve configured to allow treatment fluid to exit the chamber 321 (e.g. towards the well) (e.g. during a power stroke of the pump 300) (e.g. while preventing treatment fluid from entering the chamber 321 therethrough). In FIG. 7, the power end 310 further comprises a bore 420 (e.g. in a power end housing 413) in fluid communication with the bellows 330 (e.g. an internal volume of the bellows 330), and the piston 410 is disposed within the bore 420. In some embodiments, the piston 410 can be driven by a hydraulic circuit 430 (see FIG. 4 for example). In some embodiments, the hydraulic circuit 430 can be fluidly coupled to the make-up fluid source 780, for example drawing make-up/drive fluid from the make-up fluid source 780.

Typically, the piston 410 may have a head 412 and a rod 414, with the rod 414 extending from the head 412 and being disposed between the head 412 and the bellows 330. While the rod 414 and the head 412 may be similarly sized in some embodiments, in other embodiments the rod 414 may have a smaller diameter than the head 412. For example, the rod 414 may have a smaller diameter than the head 412 when the piston 410 is part of an intensifier configured to intensify applied pressure (e.g. from a driver) to the bellows 330. In embodiments, the bore 420 can include a first portion 422 with an inner diameter configured for movement of the head 412 (axially) therethrough and a second portion 424 with an inner diameter configured for movement of the rod 414 (axially) therethrough. For example, the head 412 may be configured to sealingly move within the first portion 422 of the bore (e.g. during pump strokes) and the rod 414 may be configured to sealingly move within the second portion 424 of the bore (e.g. during pump strokes). In embodiments, the power end 310 can include a first seal 451 (see for example FIG. 4) configured to seal the head 412 with respect to the first portion 422 of the bore and a second seal 453 configured to seal the rod 414 with respect to the second portion 424 of the bore 420. For example, the first seal 451 may be a moving seal (e.g. disposed on the head 412) and the second seal 453 may be a stationary seal (e.g. disposed on the inner surface/wall of the bore 420—e.g. within the second portion 424 of the bore—which may in some embodiments comprises pump packing).

In embodiments, the second seal 453 may be configured to provide the controlled volume of fluid (e.g. make-up/drive fluid) between the piston 410 and the bellows 330. For example, the second seal 453 may be disposed in the power end 310 with make-up/drive fluid on both sides (e.g. pressurized on both sides). The second seal 453 may be configured to separate the controlled volume of make-up/drive fluid disposed between the bellows 330 and the piston 410 from the first portion 422 of the bore 420 (e.g. with the head 412 of the piston 410 therein). In some embodiments, the second seal 453 may be configured for use in an abrasive and/or corrosive environment (e.g. for exposure to treatment fluid), despite being shielded from the treatment fluid in the chamber 321 by the bellows 330. By unconventionally using a seal 453 that can resist an abrasive and/or corrosive environment (e.g. treatment fluid), the intensifier portion of the pump 300 can be protected from bellows 330 leakage (see for example, FIG. 8, showing the second seal 453 separating contaminated fluid in the bellows 330 from the clean drive fluid in the first portion 422 of the bore 420), and in some instances this may allow the pump 300 to continue to function for some time and at some capacity even after there is a leak. The resistant seal 453 can also help prevent spread of contamination from the bellows 330 into the make-up system 510. In some embodiments, the first seal 451 may be configured for use with clean fluid (e.g. drive fluid) and/or may not be configured for use in an abrasive and/or corrosive environment and/or for use with treatment fluid. In other words, the first seal 451 may differ from the second seal 453, with the first seal 451 being more vulnerable to damage from exposure to an abrasive and/or corrosive environment and/or exposure to treatment fluid.

In embodiments, the make-up fluid source 480 can comprise make-up fluid. While the make-up fluid could be any fluid compatible with the function of the fluid between the bellows 330 and the piston 410, typically the make-up fluid may be drive fluid (e.g. hydraulic fluid, such as hydraulic oil), which may be the same drive fluid used for pump operations. For example, in FIG. 7, the same drive fluid is used between the bellows 330 and the piston 410 and/or second seal 453 (e.g. in the second portion 424 of the bore 420) as is used to power the piston head 412 (e.g. in the first portion 422 of the bore 420). In FIG. 7, the pump 300 comprises an intensifier (e.g. having a head 412 that is larger than its rod 414). In some embodiments, the intensifier may be fluidly coupled to and/or in fluid communication with the make-up fluid source 480. For example, the first portion 422 of the bore (e.g. the piston head 412) can be fluidly coupled to the make-up fluid source 480. FIGS. 7-8 illustrate such an embodiment, in which the intensifier may be in fluid communication with the make-up fluid source 780 via the make-up fluid circuit 740.

In some embodiments, the make-up system 510 can include at least one make-up port 515 in fluid communication with the bellows 330 (e.g. the second portion 424 of the bore) and the make-up fluid source 780, at least one make-up valve 752 configured to control (e.g. open or close or partially close—e.g. to control speed of flow) fluid flow between the make-up port 515/bellows 330 and the make-up fluid source 780, and/or at least one make-up pump 755 configured to pump fluid between the bellows 330 and the make-up fluid source 780. For example, the make-up fluid source 780 can be in fluid communication with the bellows 330 when the make-up valve 752 is open, and the make-up fluid source 780 can be fluidly isolated from the bellows 330 when the make-up valve 752 is closed. In embodiments, the make-up valve 752 and/or make-up pump 755 may be disposed anywhere in the fluid flow circuit 740 for the make-up system 510. For example, the make-up valve 752 can be disposed between the make-up fluid source 780 and the make-up port 515 (e.g. which can be disposed in the power end housing or fluid end housing), between the make-up port 515 and the first portion 422 of the bore, between the make-up fluid source 780 and the make-up pump 755, or between the make-up port 515 and the make-up pump 755. Similarly, the make-up pump 755 can be disposed between the make-up fluid source 780 and the make-up port 515 (e.g. which is disposed in the power end housing or fluid end housing), between the make-up port 515 and the first portion 422 of the bore, between the make-up fluid source 780 and the first portion 422 of the bore, or between the make-up port 515 and the make-up valve 752. In embodiments, fluidly isolating the make-up system 510 from the bellows 330 may comprise closing the make-up valve 752 and/or shutting off/deactivating the make-up pump 755. In some embodiments, fluidly isolating the make-up system 510 form the bellows 330 may occur automatically, for example with the control system 490 instructing a valve mechanism/actuator to close the make-up valve 752 and/or to shut off the make-up pump 755).

In some embodiments, there may be two or more make-up valves. For example, the two or more make-up valves can be disposed between the make-up fluid source and the make-up port (e.g. which is disposed in the power end housing or fluid end housing), between the make-up port and the first portion of the bore, between the make-up fluid source and the make-up pump, and/or between the make-up port and the make-up pump. Some embodiments may include two or more make-up pumps. For example, the two or more make-up pumps can be disposed between the make-up fluid source and the make-up port (e.g. which is disposed in the power end housing or fluid end housing), between the make-up port and the first portion of the bore, between the make-up fluid source and the first portion of the bore, and/or between the make-up port and the make-up valve. While any sort of bellows pump 300 may be used within the system of FIG. 7, in embodiments the bellows pump 300 (and in some embodiments, any additional pumps of the system) can be a high-pressure pump (e.g. configured to pump treatment fluid into the well at high pressures, such as up to 20000 psi).

As noted above, the make-up system 510 may be fluidly coupled to one or more additional component of the system 700, in addition to the bellows 330. For example and depending on the configuration of the system 700, the at least one other component of the system 700 can include: one or more additional bellows (e.g. 930 for of a dual bellows pump—see FIG. 9 for example—and/or 1030 for another independent (e.g. similar) pump 799 configured to draw fluid from the make-up fluid source 480 and/or to jointly pump fluid into the well—see FIG. 10 for example), one or more additional (e.g. similar) pump 799 configured to draw fluid from the fluid source 780 and/or to jointly pump fluid into the well, an intensifier (e.g. for this pump 300 and/or for one or more additional pump 799), the head 412 of the piston 420 of the pump 300 (e.g. via fluid coupling of the bellows 330 with the first portion 422 of the bore 420), and/or a hydraulic circuit (see for example 430 of FIG. 4) configured as the driver of the piston 410 (e.g. configured to reciprocally move the piston 410 within the bore 420). These additional components of the system 700 are merely exemplary, and it should be understood that there can be other types of components fluidly coupled to the fluid source 780 of the make-up system 510 in various embodiments.

Figure 9:
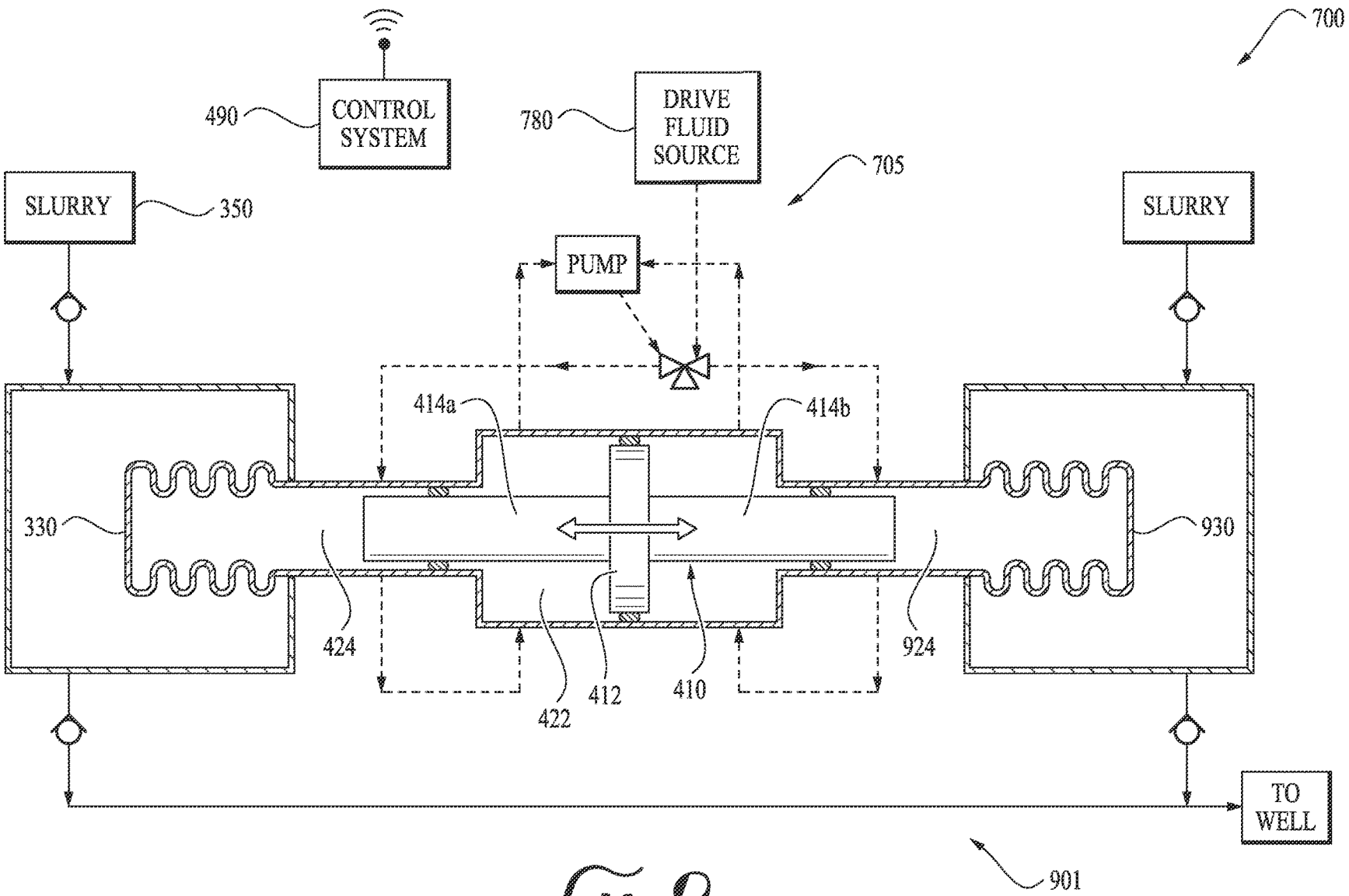
FIG. 9 is a schematic illustration of an exemplary dual-bellows pump system, according to an embodiment of the disclosure.

FIG. 9 schematically illustrates an exemplary system 700 having a dual-bellows pump 901 (which may be similar to the single bellows pump embodiments 300 in most respects). For example, the pump 901 may include a second bellows 930 (e.g. in addition to the first bellows 330), and the piston 410 may be configured to reciprocally expand and contract both the first bellows 330 and second bellows 930. For example, the piston 410 may have two rods 414*a, b* extending from opposite sides of the head 412, with one of the rods extending towards each of the two bellows of the dual bellows pump 901. The bore 420 in FIG. 9 may have a third portion 924 configured for axial movement of the second rod 414*b* towards the second bellows 930, and the third portion 924 of the bore 420 may be in fluid communication with the second bellows 930. In some embodiments, the two rods 414*a, b* may be substantially similar, and the second portion 424 and third portion 924 of the bore 420 may be substantially similar (but extending for example in opposite directions). As shown in FIG. 9, the expansion/discharge stroke for the first bellows 330 can simultaneously serve as the contraction/suction stroke for the second bellows 930, and vice versa. In some embodiments, both the first bellows 330 and the second bellows 930 can be fluidly coupled to the make-up system 510. For example, the make-up fluid source 780 can be fluidly coupled to the second bellows 930 (e.g. via a second make-up port), in addition to being coupled to the first bellows 330. In embodiments, the make-up system 510 can be configured to maintain a second controlled volume of fluid between the piston 410 and the second bellows 930 (e.g. in addition to maintaining a first controlled volume of fluid between the piston 410 and the first bellows 330). In some embodiments, a single make-up system 510 may be used for both controlled volumes, while in other embodiments separate make-up systems could be used for each. In embodiments, if either the first bellows 330 or the second bellows 930 leaks and becomes contaminated (e.g. by treatment fluid), upon detecting the leak/contamination, the controller 490 may isolate the leaking bellows from the make-up system 510. This may in turn simultaneously fluidly uncouple the two bellows 330, 930 from one another (e.g. fluidly isolating the bellows form one another), for example protecting the uncontaminated bellows from being contaminated by the leaking bellows. In some embodiments, the second bellows 930 may be one of the additional components fluidly coupled to the make-up system 510. In embodiments, fluidly isolating the first bellows 330 from the make-up system 510 (e.g. by closing the make-up valve) can fluidly isolate the first bellows 330 from the second bellows 930 (e.g. fluidly uncouple the second bellows 930 from the first bellows 330) and/or can protect the second bellows 930 from contamination via the make-up system 510.

In some embodiments, multiple pumps may be configured to jointly introduce treatment fluid into the well. In some embodiments, the plurality of pumps may be configured to provide constant pumping at approximately constant pressure. For example, one or more pump of the system 700 may be configured so that its power/discharge stroke is out of sync with the power/discharge stroke of one or more other of the pumps of the system 700. In some embodiments, half of the pumps in the system 700 may be configured to have their power/discharge strokes in sync, for example when the other half of the pumps are having their suction stroke.

Figure 10:
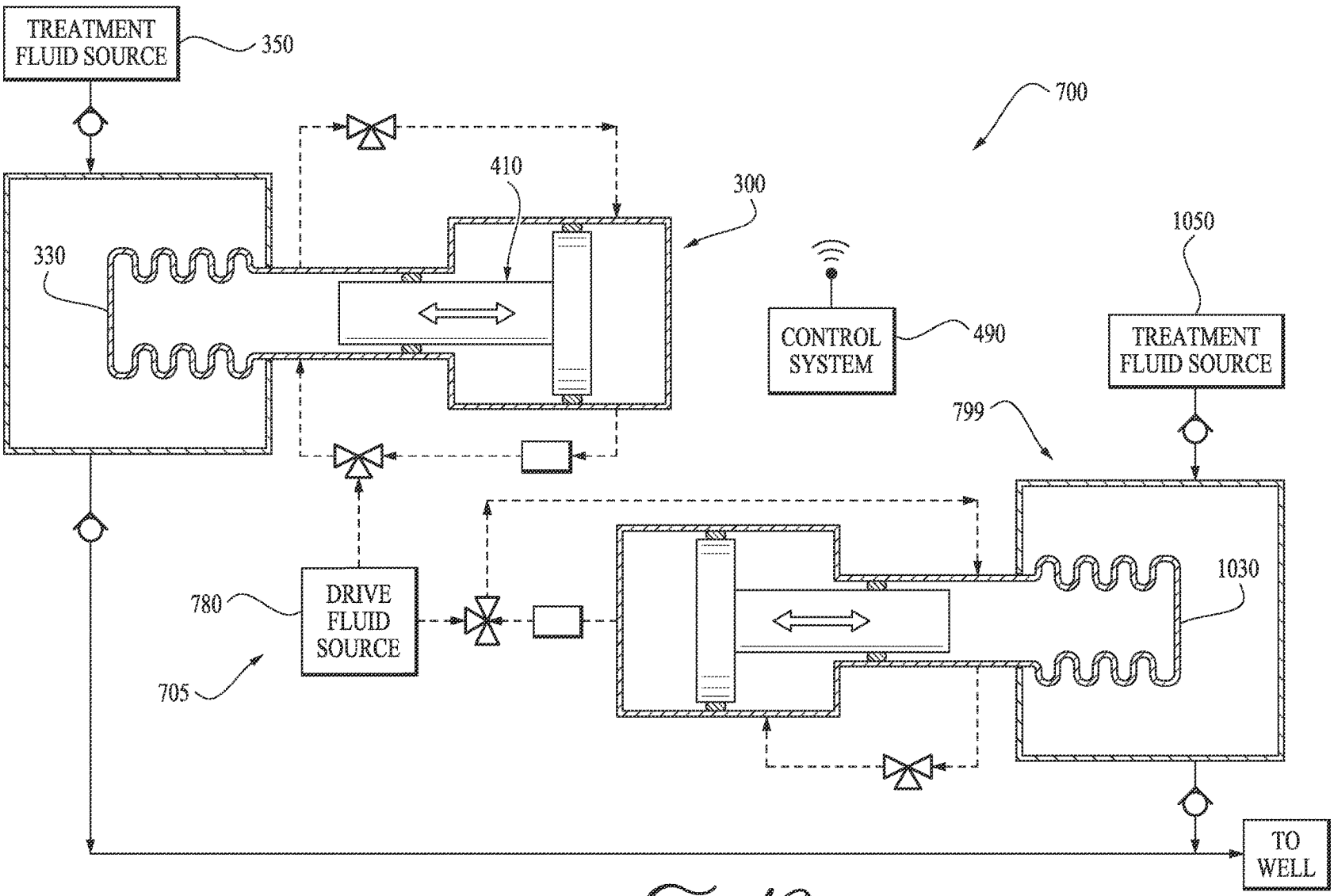
FIG. 10 is a schematic illustration of an exemplary system having two bellows pumps, according to an embodiment of the disclosure.

FIG. 10 schematically illustrates an exemplary system having two pumps 300, 799 fluidly coupled to a common make-up system 510. While both pumps 300, 799 are shown as being bellows pumps, in some embodiments, one of the pumps may not be a bellows pump (e.g. only one of the pumps may be a bellows pump). In the embodiment shown in FIG. 10, both of the pumps 300, 799 may be similar bellows pumps, and may be fluidly coupled to the make-up fluid source 780. For example, the system 700 can comprise one or more additional (e.g. similar) pump (e.g. the first bellows pump 300 and the second bellows pump 799 as shown in FIG. 10). In embodiments, the pumps (e.g. the first bellows pump 300 and the one or more additional pump, e.g. 799) can be configured to jointly pump treatment fluid into the well and/or can be fluidly coupled to the make-up fluid source 780. A common control system 490 may be used to control the entire system 700. The control system 490 may detect a leak/contamination in any of the bellows pumps of the system 700 (e.g. either the first or second bellows pump 300, 799 of FIG. 10), and may fluidly isolate the leaking bellows from the one or more non-leaking bellows. In some embodiments, the one or more additional pump (e.g. the second bellows pump 799 of FIG. 10) may be one of the additional components fluidly coupled to the make-up system 510. In embodiments, the corresponding threshold (e.g. to which the sensor data is compared to determine if there is a leak/contamination in one of the bellows) can be based on statistical deviation compared across the pumps of the system. For example, sensor data from all of the similar pumps of the system (e.g. configured to jointly pump fluid into the well) can be used to determine a threshold, for example with the threshold based on being more than a certain deviation (e.g. percentage) from the mean/average data from all system pumps.

While the two pumps 300, 799 of FIG. 10 are shown as drawing treatment fluid from separate sources 350, 1050, in other embodiments two or more pumps of the system may draw treatment fluid from a common source. So in some embodiments, two or more bellows pumps may draw treatment fluid from a common source, and they may also be fluidly coupled to a common make-up fluid source. And while the pumps in FIG. 10 are illustrated as being operated by a common control system 490, in other embodiments each pump could have its own control system, for example with the control systems communicating with each other in some embodiments. While FIG. 10 illustrates a system having two bellows pumps 300, 799, in other embodiments any number of additional bellows pumps may be configured to jointly pump treatment fluid into the well and/or to draw from (e.g. be fluidly coupled to) the same make-up fluid source 510.

Furthermore, while the suction valve 326 and the discharge valve 328 may each be one-way check valves, in alternate embodiments, any other suitable valve may be used as either the suction valve 326 and/or discharge valve 328. Although not required, as illustrated in FIGS. 7-10, the bellows pump 300 may be coupled to a pressure intensifier (e.g. having a piston 410 with head 412 larger than rod 414), which may be configured to increase the hydraulic pressure produced by the bellows pump 300. In embodiments, the pressure intensifier may be integrated into the bellows pump 300. It should be understood that various pump embodiments discussed with respect to a piston and/or intensifier may be used without the piston and/or intensifier in other embodiments (e.g. with alternate means or mechanisms for reciprocally expanding and contracting the bellows), all of which are specifically included herein. Additionally, any driver mechanism capable of reciprocally expanding and contracting the bellows may be used, and are included within the scope of this disclosure.

So, in embodiments, the systems and methods described herein may be used in controlling an injection treatment (e.g. of treatment fluid into a well). For example, the injection treatment may be done using intensifier-type pumping systems that utilize one or more bellows for pumping the treatment fluid. The control system of the pump may monitor the pumping systems, determine whether an issue, such as failure and/or contamination, occurs in the bellows, and automatically stop the pump, take mitigating actions, and/or warn an operator before the treatment fluid spreads to undesirable places.

FIGS. 7 and 8 illustrate an exemplary improved intensifier-type pumping system 300. In an embodiment, the intensifier-type pumping system may include designed components that allow for the automatic prevention of contamination from a damaged billows causing additional damage to the system (e.g. to other components of the system). In embodiments, the pumping system may include a pressure intensifier and one or more fluid ends and bellows.

In hydraulic fracturing and other well treatment operations, high pressure pumps are often used to pump treatment fluid into a well, for example pumping a slurry mixture of proppant or sand mixed with water or processed water into a shale formation. These operations can use of a variety of pump types, including hydraulic intensifier and positive displacement pumps, to pump pressurized fluid. Both hydraulic intensifiers and positive displacement pumps can use a piston to move fluid. Some of these pumps may use a bellows to separate the piston from the treatment fluid to reduce wear on the piston (e.g. with the bellows acting as a physical barrier between the treatment fluid and the piston, to physically separate the piston from the treatment fluid). The piston commonly can be surrounded by a fluid that allows the piston to move or reciprocate with minimal mechanical damage or wear due. In embodiments, this fluid or barrier may be drive fluid such as hydraulic oil or grease. This fluid generally creates the fluid (e.g., hydraulic) connection between the bellows and the piston such that they can move in synchrony. However, in some embodiments, the fluid or barrier may also support other systems on the pump or related pumps. For example, a reservoir of hydraulic fluid may be used by the system for the fluid that fluidly connects the end of piston to the bellows, and also may be used by the system for driving the pump. In some cases, there may be multiple pumps, pistons, and/or bellows that share a common fluid reservoir (e.g. of drive fluid).

The drive fluid can be critical for keeping the bellows and piston in sync and preventing damage to the piston and/or bellows. In particular, the amount of fluid between the end of the piston and the bellows must be calibrated and/or controlled such that the piston and the bellows are in proper sync. For example, one or more ports (e.g. make-up ports) may be incorporated into the system between the end of the piston and the bellows, such that make-up fluid (which can be drive fluid in some embodiments and/or hydraulic fluid) can be moved in and/or out of the bore therebetween. In some embodiments, this may be done using the make-up system. For example, the control system can monitor bellows position (e.g. in relation to piston position) and determine when to add fluid via the make-up system to keep the piston and bellows in sync. This system can have a make-up valve which can be opened to add fluid when the system does not have adequate amount or remove fluid when the system has an excess amount of fluid between the bellows and the piston. However, in the event of a break, perforation, or other damaged to the bellows, the make-up system may not be able to effectively perform its job and/or may accidentally spread contaminated fluid throughout additional components of the system (thereby causing more damage to the system and/or necessitating additional maintenance work).

For example, if an intensifier pump that had the fluid make-up system tied to the main hydraulic circuit has a bellows failure (e.g., due to fatigue or other sealing issues) then the make-up fluid (e.g., the hydraulic fluid) would be contaminated with treatment fluid (e.g., the slurry containing sand, water, and/or other chemicals). That is, the reservoir of hydraulic fluid (e.g. the make-up fluid source) could be contaminated with the abrasive and/or corrosive treatment fluid and then inadvertently pumped to other components connected to the reservoir, thereby placing each contaminated system in danger of failure. Such contamination would result in all hydraulic pumps, motors, lines, valves, and tanks needing to be repaired, replaced, or flushed to resume work, which would cause a high amount of non-productive time and/or high costs.

Advantageously, this disclosure provides examples of improved systems for detecting such failures of the bellows and reducing the chance of contamination within the hydraulic circuit. This disclosure provides systems and methods that can detect failure of a bellows and automatically respond to protect pumping system or any additional system (s)/component(s) that are connected to the make-up fluid system. In various embodiments, the detection could have selectable level of sensitivity to allow the operator to be cautious as they may like. As a result, this technology may prevent costly repairs and non-productive time for pumps which use a bellows.

Returning to FIGS. 7-8 for additional discussion, an exemplary intensifier system 700 that uses a bellows 330 to protect the moving components and seals from the abrasive and/or corrosive treatment fluid is illustrated. FIG. 7 depicts a single acting intensifier pump 300 for illustrative purposes. However, it is to be appreciated that similar techniques and arrangement may be applied on a dual acting intensifier pump (see for example 901 of FIG. 9).

The pump 300 includes an intensifier portion (e.g. power end 310) and a fluid end 320. The power end 310 includes a pump body 413 and a piston element 410. The piston element 410 is at least partially disposed within the pump body 413 (e.g. within a bore 420). The piston 410 includes a head 412 and a rod 414 portion. A pressure differential on either side of the head 412 can cause the piston element 410 to move. The rod 414 typically extends from the head 412 into a channel (e.g. the second portion 424 of the bore 420). The rod portion 414 may have a seal (e.g. second seal 453) that allows for the piston 410 to move but defines an interior volume (e.g. a controlled volume of fluid) between the distal end of the rod portion 414 of the piston element 410 and the bellows 330. The interior volume can be filled with a make-up fluid (e.g., drive fluid, such as hydraulic oil) such that the bellows 330 moves (e.g., expands or contracts) when the piston element 410 is driven.

In some embodiments, the pump 300 may include one or more seals 453 that are structured to provide a fluid seal between the rod portion 414 and walls of the bore 420 (e.g. the second portion 424 of the bore) or power end housing 413. In some embodiments, the seal 453 may be a seal that could be used in an abrasive and/or corrosive environment. In other embodiments, the seal 453 could be a seal that is rated for or designed for a clean environment (e.g., an environment that only includes non-contaminated hydraulic oil), although such embodiments may be less resilient and/or may not allow for operation of the pump after contamination. In embodiments, it may be important for maintenance personnel to update the second seal 453 to a seal that could be used in abrasive and/or corrosive environment. In this example, this may prevent the seal 453 from failing immediately when the bellows 330 fails. This is particularly advantageous in the system described herein. For example, as described herein, the system 700 can be able to detect failures of a bellows 330 before enough mechanical damages is done to render the pump 300 non-functional. Thus, without the systems 700 described herein, even using a seal 453 that can operate in a contaminated environment may not help, because the issue may not be detected until there is a mechanical failure requiring re-building or replacing of the one or more components of the system. However, in this system 700, the use of a seal 453 that has been rated to be operated within a contaminated environment allows for the pump 300 to have additional resilience during the short amount of time between a failure occurrence in the bellows 104 and when that failure is detected by the control system 490 and mitigation responses are taken. Thus, the unconventional use of a specialized seal in combination with the prevention system may extend the useful life of the pump 300 by a significant amount. Moreover, if there is a failure that is not an extreme failure, a pump 300 with such a specialized and unconventional seal 453 may be operated even if other responses are being taken by the control system 490 (e.g., the pump 300 may be operated at reduced rate or speed to limit further damage to the bellows 330, but may allow operations to complete the job before shutting off the pump 300 for repairs). Such a response may be set within the control system 490 as an automatic response if one or more compared sensor values are within a particular range (e.g. as discussed in greater detail below).

The fluid end 320 of FIG. 7 has the bellows 330 disposed within a chamber 321 of the fluid end housing 323. The bellows 330 separates the inner volume (e.g. within the bellows 330 and/or having make-up/drive fluid therein) from the chamber 321 of the fluid end 320 (e.g. having treatment fluid therein). A discharge valve 328 may have a first end fluidly connected to the chamber 321, and a suction valve 326 may have a first end connected to the chamber 321. A second side of the suction valve 326 may be coupled to a reservoir/source of treatment fluid 350 (e.g., the fluid intended to be pumped, such as a slurry). A second side of the discharge valve 328 may be connected to any place to which the treatment fluid is intended to be pumped. For example, the second side of the discharge valve 328 may be coupled to an oil and gas well. In some embodiments, the valves 326 and 328 are positioned within respective openings within the fluid end housing 323. In various embodiments, the valves 326 and 328 may be located within other components or devices, such as piping, that has a fluid connection with the chamber 321. In this way, the chamber 321 can be filled with treatment fluid as the bellows pump 300 operates.

The system 700 typically also includes a control system 490. The control system 490 may include one or more processors coupled to one or more non-volatile computer readable medium (e.g., memory devices) that comprise instructions that, when executed by the processor, cause the control system 490 to implement or perform the various operations described herein. The control system 490 and/or processors thereof may be communicably coupled to the various components for either receiving data or sending data via communication lines 790. The communication connections may be either wired or wireless. The control system 490 may, in some embodiments, be communicably coupled to other control systems or information handling systems via one or more network connections or direct connections. Additional discussion of various embodiments of the control system 490 are described with reference to FIG. 6.

The control system 490 may include one or more sensors 710 designed and arranged to measure one or more parameters of the system 700. The parameters that may be monitored include pressure, temperature, flow rate, viscosity, contamination/particle count, and/or bellows position. For example, one or more sensors 710 may be deployed to monitor the position of the bellows 330, position of the piston element 410, pressure in the chamber 321, pressure within the bellows 330 (e.g. its inner volume), and/or the amount of fluid passing through the suction valve 326, the discharge valve 328, into a port (e.g. make-up port 515) leading to the inner volume of the bellows 330, and/or into and out of ports (see for example 432 and 434 in FIG. 4) designed to allow the driving of the piston element 410 (e.g. via hydraulic circuit). For example, the control system 490 may include a first sensor 710*a* designed and arranged to monitor one or more parameters (e.g., pressure) within the chamber 321. The control system 490 may also include a second sensor 710*b* that is positioned to monitor one or more parameters (e.g., temperature, pressure, and/or position) of the bellows 330. As another example, the control system 490 may include a third sensor 710*c* that is positioned and arranged to monitor one or more parameters (e.g., temperature, pressure, viscosity, contamination, and/or flow rate) of the make-up fluid entering, within, or exiting the bellows 330 via a make-up system loop 740 (e.g. which may be at least partially located between the valve 752 and the bellows 330 (e.g. the inner volume). In a further example, the control system 490 may also include a fourth sensor 710*d* that is positioned to monitor one or more parameters (e.g., temperature, pressure, and/or position) of the piston element 410. The sensors 710 typically would be communicably coupled to the control system 490 (e.g., to the one or more processors of the control system) such that data is transferred therebetween. In some embodiments, the communication and/or connection may be done via direct wiring, wiring over a network, wireless connections such as Bluetooth, or wireless network connections.

The control system 490 may also be communicably coupled to a make-up system 510, for example communicatively coupled to a make-up valve 752, a make-up pump 755, and/or a make-up fluid source 780 (e.g. a reservoir of make-up fluid). That is, the control system 490 may be coupled to various sensors which are positioned on or part of the make-up fluid pump 755 and/or a make-up fluid source 780 in order to monitor their respective states and/or the properties of the make-up fluid therein. In various embodiments, the control system 490 is also coupled to a control system of the make-up fluid pump 755 such that the control system 490 is able to turn on or off the make-up pump 755 and/or control its speed. In some embodiments, the control system 490 is also coupled to one or more make-up valves 752 such that the control system 490 is able to issue commands that cause the one or more make-up valves 752 to actuate (e.g., open or close) in order to control the flow of the make-up fluid in the system. In various embodiments, the inputs to the control system 490 via the wired or wireless communications include sensor data from one or more sensors 710 positioned in the system that represent respective pressure, temperature, flow/rate, viscosity, contamination/particle count, and/or bellows position. In some embodiments, the outputs of the control system 490 via one or more wired or wireless communications include data that controls the make-up valve(s) 752 and/or the make-up pump(s) 755 (e.g. to control make-up fluid regarding synchronizing the bellows and piston and/or to isolate the bellows in case of leakage).

FIG. 7. depicts the system 700 having a bellows 330 that is not damaged. In this example, the controls system 490 may continue to monitor the system 700, including by way of example bellows 330 and piston element 410 or intensifier position, treatment pressure and rate, make-up fluid pressure, rate, temperature and/or may also monitor particle count or contamination via monitoring the data outputs of the sensors 710. FIG. 8 depicts the system 700 having a bellows 330 that is damaged. That is, the bellows 330 may have a leak or perforation that can allow the make-up fluid in the inner volume of the bellows 330 to be contaminated with the treatment fluid in the chamber 321.

As indicated above, the controls system 490 can be configured to monitor the bellows 330 position to identify when a bellow 330 has failed by comparing its position to the piston element 410 position. For example, the control system 490 may compare a position of the bellows 330 to a position of the piston element 410 over time and determine if the differences in relative position are abnormal. For example, the relative position differences may be compared to a threshold and/or compared to mapped data that is stored within the control system 490. The mapped data for example may include expected relative position over time for one or more cycles. A statistical deviation from the mapped data to the monitored data (e.g., taken over one or more cycles) may then be compared to a threshold (or via another analysis) to allow the control system 490 to determine whether an issue exists within the bellows 330. In some embodiments, the control system 490 may continuously monitor the relative positions. In various embodiments, the control system 490 may monitor the relative positions of the bellows 330 and the piston element 410 at particular times or intervals (e.g., set by a user based on preferences) for only a cycle or a pre-set number of cycles. In some embodiments, the monitoring by the control system 490 may be manually triggered by a user such as a maintenance personnel. In response to determining that an issue does exist (e.g., that the bellows 330 are likely compromised), the control system 490 may initiate a response automatically as discussed in greater detail below.

In the event the bellows position is not recorded (or in addition to using positional data), the control system 490 could monitor for pressure changes between make-up fluid in the inner volume of the bellows 330 and treatment fluid in the chamber 321. That is, the control system 490 may receive data representing the pressure in the bellows 330 and data representing the pressure in the chamber 321. In healthy operation, the two pressures would typically be aligned. Thus, if the two pressures are roughly equal (e.g., within a threshold value that may be set manually or adjusted over time), the control system 490 may determine that there is not an issue or concern (e.g. no leak and/or contamination). However, with a crack or other failure in the bellows 330, the two pressures would typically deviate as the piston 410 moves, and this may indicate a bellows 330 failure. In this way, the control system 490 may be configured to monitor the two pressures over multiple cycles, one cycle at a preset time, or continuously monitor and compare the two pressures and determine whether there is an issue or a deviation over a threshold value (e.g. which may be determined at one or more times during the monitoring). In some embodiments, the control system 490 may determine that there was an error or issue only if the deviation between the two pressures exceeds the threshold more than one time during multiple cycles (e.g. repeatedly, for certain pre-set number of times within a given timeframe). In response to determining an issue (e.g., that the bellows 330 are likely broken), the control system 490 can initiate a response automatically as discussed in greater detail below.

In some embodiments, the controls system 490 could also or alternatively monitor treatment fluid rate or make-up fluid for a quick change in contamination, viscosity, rate or temperature, which could indicate that treatment fluid can entered the make-up fluid system 510 (e.g. indicating a bellows failure). Such data could be used either alone or in conjunction with other sensor data. That is, the control system 490 may receive data from sensors regarding the properties of the treatment fluid within the chamber 321 and also receive data from sensors regarding one or more properties of the make-up fluid in the inner volume of the bellows 330 (or elsewhere within the make-up fluid loop 740). Certain values/thresholds of the properties or qualities may be pre-set within the control system 490, such that the control system 490 receives the sensor data and compares it to the pre-set values stored in the memory. In some embodiments, the pre-set values/thresholds may be statically set by a user or dynamically calculated based on the time of operation, the time of day, the known qualities of the treatment fluid, and/or a monitored age of the make-up fluid. If the control system 490 determines that the data representing one of the pre-set properties exceeds the respective pre-set threshold value, the control system 490 may automatically initiate a response.

In embodiments, the response may be pre-set by a user and programmed into the control system 490. In some embodiments, the response can be dependent on the particular property that was determined to be out of a range or threshold. For example, the response may include closing the make-up valve, shutting off the make-up fluid pump, sending a notification to a user device of an operator, or a combination thereof. As one example, if any of the conditions described above are met, the controls system 490 may automatically issue data commands that would close the make-up valve 752 and/or shut off the make-up fluid pump 755 to prevent contamination of the make-up fluid system. In this way, the system 700 may be able to intelligently isolate an issue before it causes a potentially catastrophic issue. Maintenance personnel may then be able to repair the system 700 before contamination spreads.

It is to be appreciated that the response and threshold values may be selectable, preprogrammed, or dynamically calculated. For example, if an operator selected (e.g., preprogrammed into the control system 490) a less sensitive setting (e.g., a high threshold value) or if the position sensors of the bellows 330 or piston element 410 were not reading properly, the controls system 490 could warn the operator (e.g., via an automatically sent notification on a graphical user interface or human-machine interface at the well location or a remote location) of a possible failure and continue to monitor for a change in make-up fluid pressure, temperature, contamination, and/or viscosity to also detect a failure that may cause the system 700 to automatically turn off as described above. That is, in some embodiments, an anomaly (e.g., a deviation) in the sensed and received data may first cause a first response (e.g., a notification or alarm to be sent or triggered) and a second anomaly (e.g., deviation) in the same or different parameter of the sensed and received data may cause a second response (e.g., closing of valves and/or turning off one or more portions of the system 700). In this example, some parameters could be used, but are not required, to indicate a failure while others may provide reassurance to the control system 490 that a failure has occurred.

As indicated above, additional benefits include improved system efficiency/performance, maintenance, Health/Safety/Environmental (HSE) impact, reliability, and packaging opportunities. Additionally or alternatively, performance may be improved via the prevention of contaminated make-up material floating through the make-up (e.g., clean) oil.

Disclosed embodiments also comprise exemplary methods for protecting a bellows pump system (e.g. from damage due to contamination of the fluid in the bellows) during introduction of treatment fluid into a well. Such methods may use any of the disclosed pump embodiments, such as the examples illustrated in FIGS. 7-10. For example, an exemplary method embodiment may comprise: pumping treatment fluid into the well using a bellows pump system, wherein the bellows pump system includes a pump having a bellows and a piston, a control system, and a make-up system configured to maintain a controlled volume of drive fluid between the piston and the bellows, wherein the make-up system is fluidly coupled to the bellows; responsive to receiving (e.g. at the control system) sensor data from one or more sensor configured to detect one or more parameter of the bellows pump system (e.g. one or more sensor disposed on the bellows pump), detecting (e.g. using the control system) a leak in the bellows using/based on the sensor data; and responsive to detecting a leak, fluidly isolating the bellows from a fluid source of the make-up system. In embodiments, the make-up system (e.g. the make-up fluid source) can be fluidly coupled to both the bellows and to at least one additional component of the system. For example, the method may further include fluidly coupling one or more additional component of the system to the fluid source for the make-up system (which is already fluidly coupled to the bellows, for example). In embodiments, fluidly isolating the bellows from the fluid source may thereby fluidly uncoupling the at least one additional component of the system from the bellows. For example, disclosed embodiments may further comprise fluidly uncoupling the at least one additional component of the system from the bellows, for example in response to fluidly isolating the bellows from the fluid source.

In embodiments, fluidly isolating the bellows from the fluid source can occur automatically and/or via the control system. In embodiments, the one or more sensor can be configured to detect one or more of the following parameters at one or more location within the system: pressure, temperature, flow rate, viscosity, contamination (e.g. particle count), and/or position of one or more component of the system. For example, the sensor data can comprise position of the bellows relative to position of the piston, pressure in the chamber relative to pressure in the bellows, flow rate of treatment fluid through the suction valve relative to flow rate if treatment fluid through the discharge valve, flow rate of make-up/drive fluid through the (e.g. one or more) make-up port (e.g. in and out) of the bellows, flow rate of make-up fluid/drive fluid (e.g. configured to drive the piston) into and out of the intensifier (e.g. the first portion of the bore of the power end), flow rate of make-up/drive fluid into and out of the make-up fluid source, viscosity of fluid in the bellows, contamination (e.g. particle count) within the bellows, and/or temperature of make-up/drive fluid within the bellows (e.g. compared to expected temperature and/or compared to temperature in the chamber). In embodiments, the one or more sensor can comprise a first sensor configured to monitor one or more parameter within the chamber, a second sensor configured to monitor one or more parameter in the bellows, a third sensor configured to monitor one or more parameter of the make-up fluid system (e.g. one or more parameter of the make-up/drive fluid entering and/or leaving the bellows (e.g. through the make-up port)), and/or a fourth sensor configured to monitor one or more parameter relating to the piston, intensifier, and/or power end.

In embodiments, detecting a leak may comprise comparing (e.g. using the control system) the sensor data to a corresponding (e.g. pre-set, pre-selected, or dynamically determined) threshold. In some embodiments, the threshold can be based on historical data. In some embodiments, the threshold can be based on statistical deviation from sensor data across a plurality of cycles of the pump (e.g. a pre-set timeframe, such as one minute, or cumulative data for the life (or some portion of the life) of the pump). In some embodiments, the bellows pump system can include one or more additional (e.g. similar) pump (e.g. having a plurality of bellows pumps), which may be configured to jointly pump treatment fluid into the well, and the corresponding threshold can be based on statistical deviation compared across the pumps of the system (e.g. deviation from the average of the plurality of pumps of the system).

In embodiments, fluidly isolating the bellows may comprise closing a make-up valve of the make-up system and/or shutting off a make-up pump of the make-up system. Some embodiments of the make-up system comprise a fluid source (e.g. of make-up/drive fluid) fluidly coupled to the bellows (e.g. via a make-up port) and at least one other component of the system. In some embodiments, fluidly isolating the bellows from the fluid source of the make-up system may include fluidly isolating the bellows from an intensifier/head of the piston, a first portion of the bore, a second bellows (e.g. in a dual bellows system and/or in one or more additional pump), and/or a second pump. Some method embodiments may further include evaluating (e.g. using the control system) the sensor data to determine whether the bellows and piston are out of sync, and responsive to determining that the bellows and piston are out of sync, using the make-up system to adjust the amount of fluid (e.g. injecting or removing make-up/drive fluid) between the piston and the bellows to return the piston and bellows to sync. For example, using the make-up system may include controlling (e.g. opening and/or closing) the make-up valve and/or the make-up pump (e.g. activating or shutting off the make-up pump).

Disclosed embodiments may have the pump include a seal disposed between the piston and a bore in which the piston is disposed (e.g. configured to maintain a controlled volume of fluid between the piston and the bellows), and the seal can be configured for an abrasive and/or corrosive environment and/or exposure to treatment fluid (e.g. even though shielded from exposure to treatment fluid by the bellows). For example, the seal may be resistant to abrasive and/or corrosive environments and/or treatment fluid. In embodiments, the method may include continuing to pump treatment fluid into the well using the bellows pump while the bellows pump is isolated and/or while there is a detected leak (for example, due to the protection offered by the resistant seal). Some embodiments may further comprise sealing between the piston and a bore of the power end in which the piston is disposed (e.g. with the seal configured to maintain a controlled volume of fluid between the piston and the bellows) using a seal that is resistant to abrasive and/or corrosive environments and/or treatment fluid. In some embodiments, the rate of pumping treatment fluid into the well may be reduced while the bellows is isolated from the fluid source of the make-up system (e.g. reducing the rate of pumping of treatment fluid into the well), for example due to contamination being contained somewhat by the resistant seal.

In some embodiments, the pump can include a hydraulic circuit configured to reciprocally drive the piston in the bore of the power end, and the hydraulic circuit can be fluidly coupled to the fluid source of the make-up system (e.g. with the drive fluid used by the hydraulic circuit coming from the fluid source). In embodiments, closing the make-up fluid valve can isolate the bellows from the hydraulic circuit. Some embodiments can further comprise pumping treatment fluid into the well using a second bellows (e.g. of a dual bellows pump) or a second (e.g. one or more additional separate) bellows pump fluidly connected to the fluid source of the make-up system and/or configured to jointly pump treatment fluid into the well. For example, the second bellows or second pump may be configured to pump treatment fluid into the well at the same time that (e.g. simultaneously with) the first bellows pump is pumping treatment fluid into the well. In embodiments, closing the make-up valve can isolate the bellows from the second bellows (e.g. fluidly uncouple the second bellows from the first bellows) and/or protects the second bellows from contamination via the make-up system. In embodiments, the second bellows may still be in fluid communication with the make-up system while pumping (even when the first bellows has been isolated). In some embodiments, the second bellows may continue pumping even after the first bellows has been isolated from the make-up system and/or has been stopped.

Some method embodiments may further comprise taking action (e.g. using the control system and/or automatically) responsive to detecting the leak and/or fluidly isolating the bellows. For example, the action can include sending an alert/notice, isolating the bellows, and/or shutting down the pump (and/or in some embodiments and in some circumstances, continuing to pump treatment fluid, for example at a lower rate). In some embodiments, sending an alert may occur before isolating the bellows from the fluid source and/or before shutting down the pump. For example, upon sensor data exceeding a first threshold, the action may be sending an alert; upon sensor data exceeding a second threshold, the action may be shutting down the pump and/or using the output to shut down the suction fluid supply.

Some embodiments may further include using a second sensor (e.g. of the one or more sensor) (e.g. to detect contamination, viscosity, etc.) to confirm whether the detected leak relates to (e.g. involves) treatment fluid (e.g. entering the bellows). For example, responsive to confirming that the detected leak involves treatment fluid, operation of the isolated pump may be stopped (e.g. ceasing to pump treatment fluid into the well). Responsive to confirming that the leak does not involve treatment fluid, operation of the pump that is isolated may continue (e.g. continuing to pump treatment fluid into the well with the isolated pump), drive/ make-up fluid (e.g. from the make-up fluid source) may be injected or removed using the make-up system, and/or fluid connection between the make-up system and the bellows may be restored.

In some embodiments, after a leak has been detected, the controlled volume of drive fluid between the piston and the bellows may be drained. For example, this may allow for repairing and/or replacing the bellows and/or the seal and/or otherwise performing maintenance on the pump. For example, the pump and/or make-up system may be flushed (e.g. the make-up valve, make-up pump, and/or fluid communication lines (e.g. piping) of the make-up system). After repairing and/or replacing the bellows and/or seal and/or performing maintenance, the make-up system may be used to inject make-up/drive fluid between the bellows and the piston (e.g. to provide the controlled volume of fluid and/or to return the piston and the bellows to sync).

One or more of the system embodiments disclosed herein (e.g. relating to FIGS. 7-10) may be used to implement any of the disclosed method embodiments and/or may be involved in any of the disclosed method embodiments. For example, a programmable storage device can have program instructions stored thereon configured to cause a processor (e.g. of the control system of the bellows pump system) to perform any of the disclosed method embodiments, and/or a non-transitory computer-readable medium can have program instructions stored thereon configured to cause a control system (e.g. of the bellows pump system) to perform any of the disclosed method embodiments. Such instructions may be used by the control system of the disclosed bellows pump system embodiments, for example to operate the bellows pump system.

ADDITIONAL DISCLOSURE

The following are non-limiting, specific embodiments in accordance with the present disclosure:

In a first embodiment, a system for pumping treatment fluid into a well comprises: a source of treatment fluid; a bellows pump in fluid communication with the source of treatment fluid and/or configured to pump treatment fluid into the well; a make-up system configured to maintain a controlled volume of fluid (e.g. make-up and/or drive fluid) between the piston and the bellows (e.g. to keep the bellows and piston in sync); and a control system having one or more sensor (e.g. configured to detect one or more parameters of the system); wherein the pump comprises: a power end comprising a piston (e.g. of an intensifier) configured to reciprocally move make-up/drive fluid (e.g. in and out of the bellows); a fluid end having a fluid end housing with a chamber, a suction valve (e.g. in fluid communication with (e.g. fluidly coupled to) the chamber and a source for the treatment fluid and/or configured for introduction of treatment fluid into the chamber), and a discharge valve (e.g. in fluid communication with (e.g. fluidly coupled to) the chamber and the well and/or configured for injection of treatment fluid from the chamber into a well); and an expandable bellows, wherein the power end is (e.g. fluidly connected to and) configured to reciprocally expand/inflate and contract/deflate the bellows based on movement of make-up/drive fluid, and the bellows is configured to expand within the chamber of the fluid end based on movement of the make-up/drive fluid; wherein the make-up system comprises a make-up fluid source fluidly coupled to the bellows and at least one other component of the system; and wherein the control system is configured to receive data from the one or more sensor, to evaluate the sensor data to detect a leak (e.g. of treatment fluid into the bellows, which could contaminate the make-up fluid source), and responsive to detecting a leak, to fluidly isolate the make-up system from the bellows (e.g. thereby fluidly uncoupling the at least one additional component of the system from the bellows).

A second embodiment can include the system of the first embodiment, wherein the control system is configured to evaluate the sensor data to determine whether the bellows and piston are out of sync, and responsive to determining that the bellows and piston are out of sync, using the make-up system to adjust the amount of fluid (e.g. injecting and/or removing make-up/drive fluid) between the piston and the bellows to return the piston and bellows to sync.

A third embodiment can include the system of the first or second embodiments, wherein the one or more sensor is configured to detect one or more of the following parameters at one or more location within the system: pressure, temperature, flow rate, viscosity, contamination (e.g. particle count), position of one or more component of the system, vibration, acoustics, and/or hydraulic gain.

A fourth embodiment can include the system of any one of the first to third embodiments, wherein the one or more sensor detects position of the bellows relative to position of the piston.

A fifth embodiment can include the system of any one of the first to fourth embodiments, wherein the one or more sensor detects pressure in the chamber relative to pressure in the bellows.

A sixth embodiment can include the system of any one of the first to fifth embodiments, wherein the one or more sensor detects flow rate of treatment fluid through the suction valve relative to flow rate if treatment fluid through the discharge valve.

A seventh embodiment can include the system of any one of the first to sixth embodiments, wherein the one or more sensor detects flow rate of make-up/drive fluid through the (e.g. one or more) make-up port (e.g. in and out) of the bellows.

An eighth embodiment can include the system of any one of the first to seventh embodiments, wherein the one or more sensor detects flow rate of make-up fluid/drive fluid (e.g. configured to drive the piston) into and out of the intensifier (e.g. the first portion of the bore of the power end).

A ninth embodiment can include the system of any one of the first to eighth embodiments, wherein the one or more sensor detects flow rate of make-up/drive fluid into and out of the make-up fluid source.

A tenth embodiment can include the system of any one of the first to ninth embodiments, wherein the one or more sensor detects viscosity of fluid in the bellows.

An eleventh embodiment can include the system of any one of the first to tenth embodiments, wherein the one or more sensor detects contamination (e.g. particle count) within the bellows.

A twelfth embodiment can include the system of any one of the first to eleventh embodiments, wherein the one or more sensor detects temperature of make-up/drive fluid within the bellows (e.g. compared to expected temperature and/or compared to temperature in the chamber).

A thirteenth embodiment can include the system of any one of the first to twelfth embodiments, wherein the one or more sensor comprise a first sensor configured to monitor one or more parameter within the chamber.

A fourteenth embodiment can include the system of any one of the first to thirteenth embodiments, wherein the one or more sensor comprises a second sensor configured to monitor one or more parameter in the bellows.

A fifteenth embodiment can include the system of any one of the first to fourteenth embodiments, wherein the one or more sensor comprises a third sensor configured to monitor one or more parameter of the make-up fluid system (e.g. one or more parameter of the make-up/drive fluid entering and/or leaving the bellows (e.g. through the make-up port)).

A sixteenth embodiment can include the system of any one of the first to fifteenth embodiments, wherein the one or more sensor comprises a fourth sensor configured to monitor one or more parameter relating to the piston, intensifier, and/or power end.

A seventeenth embodiment can include the system of any one of the first to sixteenth embodiments, wherein the control system detects a leak based on the sensor data by comparing sensor data to a corresponding threshold.

An eighteenth embodiment can include the system of the seventeenth embodiment, wherein the corresponding threshold is pre-set and/or pre-selected.

A nineteenth embodiment can include the system of any one of the seventeenth to eighteenth embodiments, wherein the corresponding threshold is based on historical data.

A twentieth embodiment can include the system of the seventeenth embodiment, wherein the corresponding threshold is dynamically determined.

A twenty-first embodiment can include the system of the seventeenth or twentieth embodiments, wherein the corresponding threshold is based on statistical deviation from sensor data across a plurality of cycles of the pump (e.g. a pre-set timeframe, such as one minute, or cumulative data for the life (or some portion of the life) of the pump).

A twenty-second embodiment can include the system of any one of the seventeenth, twentieth, or twenty-first embodiments, wherein the system comprises one or more additional (e.g. similar) pump, wherein the pumps (e.g. the first pump and the one or more additional pump) are configured to jointly pump treatment fluid into the well, and wherein the corresponding threshold is based on statistical deviation compared across the pumps of the system.

A twenty-third embodiment can include the system of the twenty-second embodiment, wherein the one or more additional pump is fluidly coupled to the make-up fluid source.

A twenty-fourth embodiment can include the system of any one of the first to twenty-third embodiments, wherein the suction valve is a one-way check valve configured to allow treatment fluid from the treatment fluid source to enter the chamber (e.g. during a suction stroke of the pump) (e.g. while preventing treatment fluid from exiting the chamber therethrough), and the discharge valve is a one-way check valve configured to allow treatment fluid to exit the chamber (e.g. towards the well) (e.g. during a power stroke of the pump) (e.g. while preventing treatment fluid from entering the chamber therethrough).

A twenty-fifth embodiment can include the system of any one of the first to twenty-fourth embodiments, wherein the power end further comprises a bore (e.g. in a power end housing) in fluid communication with the bellows (e.g. an internal volume of the bellows), and wherein the piston is disposed within the bore.

A twenty-sixth embodiment can include the system of any one of the first to twenty-fifth embodiments, wherein the piston is driven by a hydraulic circuit (which is fluidly coupled to the make-up fluid source—e.g. draws make-up/drive fluid from the make-up fluid source).

A twenty-seventh embodiment can include the system of any one of the first to twenty-sixth embodiments, wherein the piston comprises a head and a rod (e.g. with the rod extending from the head and being disposed between the head and the bellows).

A twenty-eighth embodiment can include the system of any one of the first to twenty-seventh embodiments, wherein the rod has a smaller diameter than the head.

A twenty-ninth embodiment can include the system of any one of the first to twenty-eighth embodiments, wherein the piston is part of an intensifier configured to intensify applied pressure (e.g. from a driver) to the bellows (e.g. with the rod having a smaller diameter than the head, such as 1:1.1 to 1:10).

A thirtieth embodiment can include the system of any one of the twenty-fifth to twenty-ninth embodiments, wherein the bore comprises a first portion with an inner diameter configured for movement of the head (e.g. axially) therethrough and a second portion with an inner diameter configured for movement of the rod (e.g. axially) therethrough.

A thirty-first embodiment can include the system of the thirtieth embodiment, wherein the head is configured to sealingly move within the first portion of the bore (e.g. during pump strokes) and the rod is configured to sealingly move within the second portion of the bore (e.g. during pump strokes) (e.g. the power end further comprises a first seal configured to seal the head with respect to the first portion of the bore and a second seal configured to seal the rod with respect to the second portion of the bore) (wherein the first seal may be disposed on the head (e.g. a moving seal) or on the bore first portion inner surface (e.g. a stationary seal) and/or the second seal may be disposed on the rod (e.g. a moving seal) or on the bore second portion inner surface (a stationary seal)).

A thirty-second embodiment can include the system of the thirty-first embodiment, wherein the first seal is a moving seal (e.g. disposed on the head) and the second seal is a stationary seal (e.g. disposed on the inner surface/wall of the bore—e.g. within the bore second portion—which may in some embodiments comprises pump packing).

A thirty-third embodiment can include the system of any one of the thirty-first or thirty-second embodiments, wherein the second seal (e.g. configured to provide the controlled volume of fluid (e.g. make-up/drive fluid) between the piston and the bellows) is disposed in the power end with make-up/drive fluid on both sides (e.g. pressurized on both sides) and is configured for use in an abrasive and/or corrosive environment (e.g. for exposure to treatment fluid) (e.g. despite being shielded from the treatment fluid in the chamber by the bellows).

A thirty-fourth embodiment can include the system of any one of the first to thirty-third embodiments, wherein the make-up fluid source comprises make-up fluid.

A thirty-fifth embodiment can include the system of the thirty-fourth embodiments, wherein the make-up fluid is drive fluid (e.g. hydraulic fluid, such as hydraulic oil, which may be the same fluid used as drive fluid for the pump).

A thirty-sixth embodiment can include the system of any one of the first to thirty-fifth embodiments, wherein the pump comprises an intensifier (e.g. fluidly coupled to and/or in fluid communication with the make-up fluid source).

A thirty-seventh embodiment can include the system of any one of the thirtieth to thirty-seventh embodiments, wherein the first portion of the bore (e.g. the piston head) is fluidly coupled to the make-up fluid source.

A thirty-eighth embodiment can include the system of any one of the first to thirty-seventh embodiments, wherein the make-up system further comprises a make-up port in fluid communication with the bellows and the make-up fluid source, at least one make-up valve configured to control (e.g. open or close or partially close—e.g. to control speed of flow) fluid flow between the make-up port/bellows and the make-up fluid source, and/or at least one make-up pump configured to pump fluid between the bellows and the make-up fluid source.

A thirty-ninth embodiment can include the system of the thirty-eighth embodiment, wherein the make-up fluid source is in fluid communication with the bellows when the make-up valve is open, and the make-up fluid source is fluidly isolated from the bellows when the make-up valve is closed.

A fortieth embodiment can include the system of the thirty-eighth and thirty-ninth embodiments, wherein the make-up valve is disposed between the make-up fluid source and the make-up port (e.g. which is disposed in the power end housing or fluid end housing) or between the make-up port and the first portion of the bore or between the make-up fluid source and the make-up pump or between the make-up port and the make-up pump.

A forty-first embodiment can include the system of any one of the third-eighth to fortieth embodiments, wherein the make-up pump is disposed between the make-up fluid source and the make-up port (e.g. which is disposed in the power end housing or fluid end housing) or between the make-up port and the first portion of the bore or between the make-up fluid source and the first portion of the bore or between the make-up port and the make-up valve.

A forty-second embodiment can include the system of any one of the first to forty-first embodiments, wherein fluidly isolating the make-up system from the bellows comprises closing the make-up valve and/or shutting off/deactivating the make-up pump (e.g. automatically by the control system—e.g. the control system instructs a valve mechanism/actuator to close the make-up valve and/or to shut off the pump).

A forty-third embodiment can include the system of any one of the first to forty-second embodiments, wherein the at least one other component of the system (e.g. fluidly coupled to the make-up system) comprises: a second bellows (e.g. for a dual bellows pump or for another independent (e.g. similar) pump configured to draw fluid from the make-up fluid source and/or to jointly pump fluid into the well) (e.g. one or more additional bellows), a second pump (e.g. one or more additional (e.g. similar) pump configured to draw fluid from the fluid source and/or to jointly pump fluid into the well), an intensifier (e.g. for this pump and/or for one or more additional pump), the head of the piston of the pump (e.g. via fluid coupling with the first portion of the bore), and/or a hydraulic circuit configured as the driver of the piston (e.g. configured to reciprocally move the piston within the bore).

A forty-fourth embodiment can include the system of any one of the first to forty-third embodiments, wherein the pump comprises a second bellows (e.g. a dual-bellows pump), wherein the piston is configured to reciprocally expand and contract both the first and second bellows (e.g. with the expansion/discharge stroke for one bellows serving as the contraction/suction stroke for the other bellows, and vice versa).

A forty-fifth embodiment can include the system of the forty-fourth embodiment, wherein the make-up fluid system is fluidly coupled to the second bellows (e.g. via a second make-up port) (e.g. and is configured to maintain a second controlled volume of fluid between the piston and the second bellows) (and for example in some embodiments, closing the make-up valve can fluidly uncouple the second bellows from the first bellows).

A forty-sixth embodiment can include the system of any one of the third-eighth to forty-fifth embodiments, wherein the make-up valve comprises two or more make-up valves.

A forty-seventh embodiment can include the system of the forty-sixth embodiments, wherein the two or more make-up valves are disposed between the make-up fluid source and the make-up port (e.g. which is disposed in the power end housing or fluid end housing) and/or between the make-up port and the first portion of the bore and/or between the make-up fluid source and the make-up pump and/or between the make-up port and the make-up pump.

A forty-eighth embodiment can include the system of any one of the third-eighth to forty-seventh embodiments, wherein the make-up pump comprises two or more make-up pumps.

A forty-ninth embodiment can include the system of the forty-eighth embodiment, wherein the two or more make-up pumps are disposed between the make-up fluid source and the make-up port (e.g. which is disposed in the power end housing or fluid end housing) and/or between the make-up port and the first portion of the bore and/or between the make-up fluid source and the first portion of the bore and/or between the make-up port and the make-up valve.

A fiftieth embodiment can include the system of any one of the first to forty-ninth embodiments, wherein the bellows pump (and in some embodiments, any additional pumps of the system) is a high-pressure pump (e.g. configured to pump treatment fluid into the well at high pressures).

A fifty-first embodiment can include the system of any one of the first to fiftieth embodiments, wherein the system further comprises a well, and wherein the pump is configured to introduce treatment fluid into the well (e.g. the discharge valve of the pump is in fluid communication with the well (either directly or indirectly)).

In a fifty-second embodiment, a method for protecting a bellows pump system during introduction of treatment fluid into a well comprises pumping treatment fluid into the well using the bellows pump system, wherein the bellows pump system comprises a pump having a bellows and a piston, a control system, and a make-up system configured to maintain a controlled volume of drive fluid between the piston and the bellows, and wherein the make-up system is fluidly coupled to the bellows and to at least one additional component of the system; responsive to receiving (e.g. at the control system) sensor data from one or more sensor configured to detect one or more parameter of the bellows pump system (e.g. one or more sensor disposed on the bellows pump), detecting (e.g. using the control system) a leak in the bellows using/based on the sensor data; and responsive to detecting a leak, fluidly isolating the bellows from a fluid source of the make-up system (e.g. thereby fluidly uncoupling the at least one additional component of the system from the bellows).

A fifty-third embodiment can include the method of the fifty-second embodiment, wherein fluidly isolating the bellows from the fluid source occurs automatically and/or using the control system.

A fifty-fourth embodiment can include the method of any one of the fifty-second to fifty-third embodiments, wherein the one or more sensor is configured to detect one or more of the following parameters at one or more location within the system: pressure, temperature, flow rate, viscosity, contamination (e.g. particle count), and/or position of one or more component of the system.

A fifty-fifth embodiment can include the method of any one of the fifty-second to fifty-fourth embodiments, wherein the sensor data comprises position of the bellows relative to position of the piston.

A fifty-sixth embodiment can include the method of any one of the fifty-second to fifty-third embodiments, wherein the sensor data comprises pressure in the chamber relative to pressure in the bellows.

A fifty-seventh embodiment can include the method of any one of the fifty-second to fifty-sixth embodiments, wherein the sensor data comprises flow rate of treatment fluid through the suction valve relative to flow rate if treatment fluid through the discharge valve.

A fifty-eighth embodiment can include the method of any one of the fifty-second to fifty-seventh embodiments, wherein the sensor data comprises flow rate of make-up/drive fluid through the (e.g. one or more) make-up port (e.g. in and out) of the bellows.

A fifty-ninth embodiment can include the method of any one of the fifty-second to fifty-eighth embodiments, wherein the sensor data comprises flow rate of make-up fluid/drive fluid (e.g. configured to drive the piston) into and out of the intensifier (e.g. the first portion of the bore of the power end).

A sixtieth embodiment can include the method of any one of the fifty-second to fifty-ninth embodiments, wherein the sensor data comprises flow rate of make-up/drive fluid into and out of the make-up fluid source.

A sixty-first embodiment can include the method of any one of the fifty-second to sixtieth embodiments, wherein the sensor data comprises viscosity of fluid in the bellows.

A sixty-second embodiment can include the method of any one of the fifty-second to sixty-first embodiments, wherein the sensor data comprises contamination (e.g. particle count) within the bellows.

A sixty-third embodiment can include the method of any one of the fifty-second to sixty-second embodiments, wherein the sensor data comprises temperature of make-up/drive fluid within the bellows (e.g. compared to expected temperature and/or compared to temperature in the chamber).

A sixty-fourth embodiment can include the method of any one of the fifty-second to sixty-third embodiments, wherein the one or more sensor comprises a first sensor configured to monitor one or more parameter within the chamber.

A sixty-fifth embodiment can include the method of any one of the fifty-second to sixty-fourth embodiments, wherein the one or more sensor comprises a second sensor configured to monitor one or more parameter in the bellows.

A sixty-sixth embodiment can include the method of any one of the fifty-second to sixty-fifth embodiments, wherein the one or more sensor comprises a third sensor configured to monitor one or more parameter of the make-up fluid system (e.g. one or more parameter of the make-up/drive fluid entering and/or leaving the bellows (e.g. through the make-up port)).

A sixty-seventh embodiment can include the method of any one of the fifty-second to sixty-sixth embodiments, wherein the one or more sensor comprises a fourth sensor configured to monitor one or more parameter relating to the piston, intensifier, and/or power end.

A sixty-eighth embodiment can include the method of any one of the fifty-second to sixty-seventh embodiments, wherein detecting a leak comprises comparing (e.g. using the control system) the sensor data to a corresponding (e.g. pre-set, pre-selected, or dynamically determined) threshold.

A sixty-ninth embodiment can include the method of the sixty-eighth embodiment, wherein the threshold is based on historical data.

A seventieth embodiment can include the method of any one of the sixty-eighth to sixty-ninth embodiments, wherein the threshold is based on statistical deviation from sensor data across a plurality of cycles of the pump (e.g. a pre-set timeframe, such as one minute, or cumulative data for the life (or some portion of the life) of the pump).

A seventy-first embodiment can include the method of any one of the sixty-eighth to seventieth embodiments, wherein the bellows pump system comprises one or more additional (e.g. similar) pump (e.g. which may be the at least one additional component of the system in some embodiments), wherein the pumps (e.g. the first pump and the one or more additional pump) are configured to jointly pump treatment fluid into the well, and wherein the corresponding threshold is based on statistical deviation compared across the pumps of the system (e.g. deviation from the average of the plurality of pumps of the system).

A seventy-second embodiment can include the method of any one of the fifty-second to seventy-first embodiments, wherein fluidly isolating the bellows comprises closing a make-up valve of the make-up system and/or shutting off a make-up pump of the make-up system.

A seventy-third embodiment can include the method of any one of the fifty-second to seventy-second embodiments, wherein the make-up system comprises a fluid source (e.g. of make-up/drive fluid) fluidly coupled to the bellows (e.g. via a make-up port) and to the at least one additional component of the system.

A seventy-fourth embodiment can include the method of any one of the fifty-second to seventy-seventy-third embodiments, wherein the at least one additional component comprises one or more selected from the following: the intensifier/head of the piston, the first portion of the bore, a second bellows (e.g. in a dual bellows system and/or in one or more additional pump), one or more additional pump, and combinations thereof.

A seventy-fifth embodiment can include the method of any one of the fifty-second to seventy-fourth embodiments, wherein the make-up system further comprises a make-up port in fluid communication with the bellows and the fluid source, at least one make-up valve configured to control (e.g. open or close) fluid flow between the make-up port/bellows and the fluid source, and/or at least one make-up pump configured to pump fluid between the bellows and the fluid source (e.g, wherein the control system may be configured to operate the make-up valve and/or the make-up pump, for example by sending signals to corresponding actuators).

A seventy-sixth embodiment can include the method of the seventy-fifth embodiment, wherein the fluid source is in fluid communication with the bellows when the make-up valve is open, and the fluid source is fluidly isolated from the bellows when the make-up valve is closed.

A seventy-seventh embodiment can include the method of any one of the fifty-second to seventy-sixth embodiments, wherein fluidly isolating the bellows from the fluid source of the make-up system comprises fluidly isolating (e.g. fluidly uncoupling) the bellows from the intensifier/head of the piston, first portion of the bore, a second bellows (e.g. in a dual bellows system and/or in one or more additional pump), and/or one or more additional (e.g. second) pump (e.g. any of which may be the at least one additional component of the system in some embodiments).

A seventy-eighth embodiment can include the method of any one of the fifty-second to seventy-seventh embodiments, further comprising evaluating (e.g. using the control system) the sensor data to determine whether the bellows and piston are out of sync, and responsive to determining that the bellows and piston are out of sync, using the make-up system to adjust the amount of fluid (e.g. injecting or removing make-up/drive fluid) between the piston and the bellows to return the piston and bellows to sync.

A seventy-ninth embodiment can include the method of any one of the fifty-second to seventy-eighth embodiments, wherein using the make-up system comprises controlling (e.g. opening and/or closing) the make-up valve and/or the make-up pump (e.g. activating or shutting off the make-up pump).

An eightieth embodiment can include the method of any one of the fifty-second to seventy-ninth embodiments, wherein the pump further comprises a seal disposed between the piston and a bore in which the piston is disposed (e.g. configured to maintain a controlled volume of fluid between the piston and the bellows), wherein the seal is configured for an abrasive and/or corrosive environment and/or exposure to treatment fluid (e.g. even though shielded from exposure to treatment fluid by the bellows) (e.g. even though disposed in a power end of the pump, such that it should only be exposed to clean drive/make-up fluid, since the bellows is configured to separate drive fluid of the power end from treatment fluid of a fluid end), the method further comprising continuing to pump treatment fluid into the well using the bellows pump while the bellows pump is isolated and/or while there is a detected leak.

An eighty-first embodiment can include the method of any one of the fifty-second to eightieth embodiments, further comprising sealing between the piston and a bore of the power end in which the piston is disposed (e.g. with the seal configured to maintain a controlled volume of fluid between the piston and the bellows) using a seal that is resistant to abrasive environments and/or treatment fluid.

An eighty-second embodiment can include the method of the eightieth or eighty-first embodiments, wherein the rate of pumping treatment fluid into the well is reduced while the bellows is isolated from the fluid source of the make-up system (e.g. the method further comprising reducing (e.g. using the control system) the rate of pumping of treatment fluid into the well).

An eighty-third embodiment can include the method of any one of the seventy-fifth to eighty-second embodiments, wherein the pump further comprises a hydraulic circuit configured to reciprocally drive the piston in the bore of the power end, wherein the hydraulic circuit is fluidly coupled to the fluid source of the make-up system (e.g. with the drive fluid used by the hydraulic circuit coming from the source), and wherein closing the make-up fluid valve isolates (e.g. fluidly uncouples) the bellows from the hydraulic circuit (e.g, wherein the at least one additional component of the system comprises a hydraulic circuit).

An eighty-fourth embodiment can include the method of any one of the seventy-fifth to eighty-third embodiments, further comprising pumping treatment fluid into the well using a second bellows (e.g. of a dual bellows pump) or second (e.g. one or more additional separate) bellows pump fluidly connected to the fluid source of the make-up system and/or configured to jointly pump treatment fluid into the well (e.g. at the same time that the first bellows pump is pumping treatment fluid into the well).

An eighty-fifth embodiment can include the method of the eighty-fourth embodiment, wherein closing the make-up valve fluidly isolates (e.g. fluidly uncoupled) the bellows from the second bellows and/or protects the second bellows from contamination via the make-up system.

An eighty-sixth embodiment can include the method of the eighty-fifth embodiment, wherein the second bellows is still in fluid communication with the make-up system while pumping.

An eighty-seventh embodiment can include the method of any one of the eighty-fourth to eighty-sixth embodiments, wherein the one or more additional bellows pump is configured so that its discharge stroke is not in sync with the discharge stroke of the first pump (e.g. configured so that the plurality of pumps provide continuous pumping at approximately constant pressure).

An eighty-eighth embodiment can include the method of any one of the fifty-second to eighty-seventh embodiments, further comprising taking action (e.g. using the control system and/or automatically) responsive to detecting the leak and/or fluidly isolating the bellows.

An eighty-ninth embodiment can include the method of the eighty-eighth embodiment, wherein the action comprises sending an alert/notice and/or shutting down the pump (and/or in some embodiments and in some circumstances, continuing to pump treatment fluid, for example at a lower rate).

A ninetieth embodiment can include the method of the eighty-ninth embodiment, wherein sending an alert occurs before isolating the bellows from the fluid source and/or before shutting down the pump.

A ninety-first embodiment can include the method of any one of the eighty-eighth to ninetieth embodiments, wherein, upon sensor data exceeding a first threshold, the action comprises sending an alert.

A ninety-second embodiment can include the method of any one of the eighty-eighth to ninety-first embodiments, wherein, upon sensor data exceeding a second threshold, the action comprises shutting down the pump.

A ninety-third embodiment can include the method of any one of the fifty-second to ninety-second embodiments, further comprising using a second sensor (e.g. of the one or more sensor) (e.g. to detect contamination, viscosity, etc.) to confirm whether the detected leak relates to (e.g. involves) treatment fluid (e.g. entering the bellows).

A ninety-fourth embodiment can include the method of the ninety-third embodiment, further comprising, responsive to confirming that the detected leak involves treatment fluid, stopping operation of the isolated pump (e.g. ceasing to pump treatment fluid into the well).

A ninety-fifth embodiment can include the method of the ninety-third embodiment, further comprising, responsive to confirming that the leak does not involve treatment fluid, continuing operation of the pump that is isolated (e.g. continuing to pump treatment fluid into the well with the isolated pump), injecting drive/make-up fluid (e.g. from the make-up fluid source) using the make-up system, and/or restoring fluid connection between the make-up system and the bellows.

A ninety-sixth embodiment can include the method of any one of the fifty-second to ninety-fifth embodiments, wherein the bellows pump system comprises any one of the first to fifty-first system embodiments.

A ninety-seventh embodiment can include the system of any one of the first to fifty-first embodiments, configured to carry out the method of any one of the fifty-second to ninety-sixth embodiments.

In a ninety-eighth embodiment, a programmable storage device having program instructions stored thereon for causing a processor to perform the method according to any one of the fifty-second to ninety-sixth embodiments.

In a ninety-ninth embodiment, a non-transitory computer-readable medium having program instructions stored thereon for causing a control system to perform the method of any one of the fifty-second to ninety-sixth embodiments.

While embodiments have been shown and described, modifications thereof can be made by one skilled in the art without departing from the spirit and teachings of this disclosure. The embodiments described herein are exemplary only, and are not intended to be limiting. Many variations and modifications of the embodiments disclosed herein are possible and are within the scope of this disclosure. For example, the various elements or components may be combined or integrated in another system or certain features may be omitted or not implemented. Also, techniques, systems, subsystems, and methods described and illustrated in the various embodiments as discrete or separate may be combined or integrated with other techniques, systems, subsystems, or methods without departing from the scope of this disclosure. Other items shown or discussed as directly coupled or connected or communicating with each other may be indirectly coupled, connected, or communicated with. Method or process steps set forth may be performed in a different order. The use of terms, such as "first," "second," "third" or "fourth" to describe various processes or structures is only used as a shorthand reference to such steps/structures and does not necessarily imply that such steps/structures are performed/formed in that ordered sequence (unless such requirement is clearly stated explicitly in the specification).

Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, Rl, and an upper limit, Ru, is disclosed, any number falling within the range is specifically disclosed. In particular, the following numbers within the range are specifically disclosed: $R=Rl+k*(Ru-Rl)$, wherein k is a variable ranging from 1 percent to 100 percent with a 1 percent increment, i.e., k is 1 percent, 2 percent, 3 percent, 4 percent, 5 percent, 50 percent, 51 percent, 52 percent, 95 percent, 96 percent, 97 percent, 98 percent, 99 percent, or 100 percent. Moreover, any numerical range defined by two R numbers as defined in the above is also specifically disclosed. Language of degree used herein, such as "approximately," "about," "generally," and "substantially," represent a value, amount, or characteristic close to the stated value, amount, or characteristic that still performs a desired function or achieves a desired result. For example, the language of degree may mean a range of values as understood by a person of skill or, otherwise, an amount that is +/−10%.

Use of broader terms such as comprises, includes, having, etc. should be understood to provide support for narrower terms such as consisting of, consisting essentially of, comprised substantially of, etc. When a feature is described as "optional," both embodiments with this feature and embodiments without this feature are disclosed. Similarly, the present disclosure contemplates embodiments where this "optional" feature is required and embodiments where this feature is specifically excluded. The use of the terms such as "high-pressure" and "low-pressure" is intended to only be descriptive of the component and their position within the systems disclosed herein. That is, the use of such terms should not be understood to imply that there is a specific operating pressure or pressure rating for such components. For example, the term "high-pressure" describing a manifold should be understood to refer to a manifold that receives pressurized fluid that has been discharged from a pump irrespective of the actual pressure of the fluid as it leaves the pump or enters the manifold. Similarly, the term "low-pressure" describing a manifold should be understood to refer to a manifold that receives fluid and supplies that fluid to the suction side of the pump irrespective of the actual pressure of the fluid within the low-pressure manifold.

Accordingly, the scope of protection is not limited by the description set out above but is only limited by the claims which follow, that scope including all equivalents of the subject matter of the claims. Each and every claim is incorporated into the specification as embodiments of the present disclosure. Thus, the claims are a further description and are an addition to the embodiments of the present disclosure. The discussion of a reference herein is not an admission that it is prior art, especially any reference that can have a publication date after the priority date of this application. The disclosures of all patents, patent applications, and publications cited herein are hereby incorporated by reference, to the extent that they provide exemplary, procedural, or other details supplementary to those set forth herein.

Use of the phrase "at least one of" preceding a list with the conjunction "and" should not be treated as an exclusive list and should not be construed as a list of categories with one item from each category, unless specifically stated otherwise. A clause that recites "at least one of A, B, and C" can be infringed with only one of the listed items, multiple of the listed items, and one or more of the items in the list and another item not listed.

As used herein, the term "or" is inclusive unless otherwise explicitly noted. Thus, the phrase "at least one of A, B, or C" is satisfied by any element from the set {A, B, C} or any combination thereof, including multiples of any element.

As used herein, the term "and/or" includes any combination of the elements associated with the "and/or" term. Thus, the phrase "A, B, and/or C" includes any of A alone, B alone, C alone, A and B together, B and C together, A and C together, or A, B, and C together.

What is claimed is:

1. A method for protecting a bellows pump system during introduction of treatment fluid into a well, comprising:

pumping treatment fluid into the well using the bellows pump system, wherein the bellows pump system comprises a pump having a bellows and a piston, a control system, and a make-up system configured to maintain a controlled volume of drive fluid between the piston and the bellows, and wherein the make-up system is fluidly coupled to the bellows and to at least one additional component of the system;

responsive to receiving, at the control system, sensor data from one or more sensors configured to detect one or more parameters of the bellows pump system, detecting a leak in the bellows based on the sensor data; and responsive to detecting a leak, fluidly isolating the bellows from a fluid source of the make-up system, thereby fluidly uncoupling the at least one additional component of the system from the bellows, wherein fluidly isolating the bellows comprises closing a make-up valve of the make-up system and/or shutting off a make-up pump of the make-up system, and wherein the pump having the bellows and the piston further comprises a hydraulic circuit configured to reciprocally drive the piston in a power end bore, wherein the hydraulic circuit is fluidly coupled to the fluid source of the make-up system, and wherein closing the make-up valve fluidly isolates the bellows from the hydraulic circuit.

2. The method of claim 1, further comprising pumping treatment fluid into the well using a second bellows, wherein closing the make-up valve isolates the first bellows from the second bellows.

3. The method of claim 1, wherein detecting a leak comprises comparing, using the control system, the sensor data to a corresponding threshold.

4. The method of claim 1, further comprising evaluating the sensor data to determine whether the bellows and piston are out of sync, and responsive to determining that the bellows and piston are out of sync, using the make-up system to adjust an amount of drive fluid between the piston and the bellows to return the piston and bellows to sync.

5. The method of claim 1, wherein:

the pump having the bellows and the piston further comprises a seal disposed between the piston and a bore in which the piston is disposed which is configured to maintain the controlled volume of fluid between the piston and the bellows, and the seal is configured for an abrasive and/or corrosive environment even though shielded from exposure to treatment fluid by the bellows.

6. The method of claim 5, further comprising continuing to pump treatment fluid into the well using the pump having the bellows and the piston while the bellows is isolated.

* * * * *